US010414069B2

(12) United States Patent
Miess et al.

(10) Patent No.: US 10,414,069 B2
(45) Date of Patent: Sep. 17, 2019

(54) CUTTING TOOL ASSEMBLIES INCLUDING SUPERHARD WORKING SURFACES, MATERIAL-REMOVING MACHINES INCLUDING CUTTING TOOL ASSEMBLIES, AND METHODS OF USE

(71) Applicant: US Synthetic Corporation, Orem, UT (US)

(72) Inventors: David P. Miess, Highland, UT (US); Michael James Gleason, Orem, UT (US); Samuel Earl Wilding, Springville, UT (US); Regan Leland Burton, Saratoga Springs, UT (US); Paul Douglas Jones, Elk Ridge, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 345 days.

(21) Appl. No.: 14/266,437

(22) Filed: Apr. 30, 2014

(65) Prior Publication Data

US 2015/0314483 A1 Nov. 5, 2015

(51) Int. Cl.

| | |
|---|---|
| ***E01C 23/088*** | (2006.01) |
| ***E01C 23/12*** | (2006.01) |
| ***E21C 35/183*** | (2006.01) |
| ***B28D 1/18*** | (2006.01) |

(Continued)

(52) U.S. Cl.

CPC ..... *B28D 1/186* (2013.01); *E01C 23/088* (2013.01); *E01C 23/127* (2013.01); *E21C 35/183* (2013.01); *E21C 35/193* (2013.01); *E21C 2035/1806* (2013.01);

(Continued)

(58) Field of Classification Search

CPC .. E21C 35/183; E21C 35/193; E21C 35/1936; E21C 2035/1803; E21C 2035/1806; E21C 2035/1809; E21C 2035/1813; E21C 2035/1816;

(Continued)

(56) References Cited

U.S. PATENT DOCUMENTS

| | | | |
|---|---|---|---|
| 2,665,893 | A | 1/1954 | Ball |
| 3,342,532 | A | 9/1967 | Krekeler et al. |
| 3,671,075 | A | 6/1972 | Bland et al. |

(Continued)

FOREIGN PATENT DOCUMENTS

| | | |
|---|---|---|
| AU | 2013101370 | 11/2013 |
| CN | 102108866 | 6/2011 |

(Continued)

OTHER PUBLICATIONS

U.S. Appl. No. 14/273,360, Aug. 17, 2016, Issue Notification.

(Continued)

*Primary Examiner* — David J Bagnell
*Assistant Examiner* — Michael A Goodwin
(74) *Attorney, Agent, or Firm* — Dorsey & Whitney LLP

(57) ABSTRACT

Embodiments of the invention are directed to cutting tool assemblies, material-removing machines that include cutting tool assemblies, and methods of use and operation thereof. In some embodiments, the cutting tool assemblies described herein may be used in material-removing machines that may remove target material. For example, the cutting tool assemblies may include one or more superhard working surfaces and/or one or more shields.

26 Claims, 17 Drawing Sheets

(51) Int. Cl.
*E21C 35/193* (2006.01)
*E21C 35/18* (2006.01)

(52) U.S. Cl.
CPC ..... *E21C 2035/1809* (2013.01); *E21C 2035/1813* (2013.01); *E21C 2035/1816* (2013.01)

(58) Field of Classification Search
CPC . E21C 2035/182; B28D 1/186; E01C 23/127; E01C 23/088
See application file for complete search history.

(56) References Cited

U.S. PATENT DOCUMENTS 3,695,726 A 10/1972 Krekeler
3,751,114 A 8/1973 Davis
3,785,021 A 1/1974 Norgren et al.
3,841,708 A 10/1974 Kniff et al.
D238,243 S 12/1975 Polivka
3,958,832 A 5/1976 Sigott et al.
4,006,936 A 2/1977 Crabiel
4,083,644 A 4/1978 Friedline et al.
4,140,189 A 2/1979 Garner
4,193,638 A 3/1980 Heckenhauer
4,200,159 A 4/1980 Jurgens et al.
4,299,424 A 11/1981 LeBegue et al.
4,303,136 A 12/1981 Ball
4,335,921 A 6/1982 Swisher, Jr. et al.
4,337,980 A 7/1982 Krekeler et al.
4,340,325 A 7/1982 Gowanlock et al.
D270,059 S 8/1983 Wilkins
D271,497 S 11/1983 Green
4,484,644 A 11/1984 Cook et al.
4,580,930 A 4/1986 Zinner et al.
4,605,343 A 8/1986 Hibbs, Jr. et al.
4,655,508 A 4/1987 Tomilson
4,678,237 A 7/1987 Collin et al.
4,679,858 A 7/1987 Tank
D296,107 S 6/1988 Andersson
4,784,023 A 11/1988 Dennis et al.
4,787,466 A 11/1988 Tomlinson et al.
4,836,178 A 6/1989 Tomlinson
4,850,649 A 7/1989 Beach et al.
4,880,278 A 11/1989 Tomilson
4,902,073 A 2/1990 Tomlinson et al.
D307,279 S 4/1990 Vincent
4,913,125 A 4/1990 Bunting et al.
D311,747 S 10/1990 Mihic
4,998,574 A * 3/1991 Beach ..... A01G 23/067 144/231
5,007,685 A 4/1991 Beach et al.
5,060,739 A 10/1991 Griffin et al.
5,090,491 A 2/1992 Tibbitts et al.
5,318,351 A 6/1994 Walker
5,378,050 A 1/1995 Kammerer et al.
5,417,475 A 5/1995 Graham et al.
5,431,239 A 7/1995 Tibbitts et al.
5,605,382 A 2/1997 Massa et al.
5,649,604 A 7/1997 Fuller et al.
5,690,393 A 11/1997 Massa et al.
5,881,830 A 3/1999 Cooley
6,089,123 A 7/2000 Chow et al.
6,213,931 B1 4/2001 Twardowski et al.
6,283,844 B1 9/2001 Tank
6,485,104 B1 11/2002 Keller et al.
6,779,850 B1 8/2004 Schibeci et al.
7,108,212 B2 9/2006 Latham
D558,802 S 1/2008 Nicholas
D616,003 S 5/2010 Ueda et al.
7,866,418 B2 1/2011 Bertagnolli et al.
7,998,573 B2 8/2011 Qian et al.
8,034,136 B2 10/2011 Sani
8,047,260 B2 11/2011 Uno et al.
8,079,785 B2 12/2011 Nicholas
8,236,074 B1 8/2012 Bertagnolli et al.
D666,640 S 9/2012 Cox et al.
8,567,533 B2 10/2013 Myers et al.
8,672,415 B2 3/2014 Neilson et al.
8,727,044 B2 5/2014 Qian et al.
8,789,894 B2 7/2014 Claesson et al.
9,017,438 B1 * 4/2015 Miess ..... B24D 3/06 51/293
9,027,675 B1 5/2015 Jones et al.
9,028,008 B1 5/2015 Bookhamer
9,238,893 B2 1/2016 Latham et al.
9,272,392 B2 3/2016 Mukhopadhyay et al.
9,272,814 B2 3/2016 Carver et al.
9,303,511 B2 4/2016 George et al.
9,382,794 B2 7/2016 Latham et al.
9,434,091 B2 9/2016 Burton et al.
9,593,577 B2 3/2017 Lachmann et al.
D809,031 S 1/2018 Burton
10,018,041 B2 7/2018 Wachsmann et al.
2001/0040053 A1 11/2001 Beuershausen et al.
2002/0153175 A1 10/2002 Ojanen et al.
2003/0234569 A1 12/2003 Dawood et al.
2005/0082898 A1 4/2005 Keller et al.
2006/0033379 A1 2/2006 Frear et al.
2006/0087169 A1 4/2006 Hesse et al.
2007/0090679 A1 4/2007 Ojanen et al.
2008/0030065 A1 2/2008 Frear et al.
2008/0035383 A1 * 2/2008 Hall ..... E21C 35/183 175/414
2008/0036280 A1 * 2/2008 Hall ..... E21C 35/183 299/105
2008/0202819 A1 * 8/2008 Fader ..... E21C 35/18 175/401
2008/0250724 A1 10/2008 Hall et al.
2008/0309146 A1 12/2008 Hall et al.
2009/0256413 A1 * 10/2009 Majagi ..... B28D 1/188 299/100
2010/0052406 A1 3/2010 Beach et al.
2010/0194176 A1 * 8/2010 Lucek ..... E21C 35/183 299/29
2010/0244545 A1 9/2010 Hall et al.
2010/0326741 A1 12/2010 Patel
2011/0132667 A1 6/2011 Smallman et al.
2011/0148178 A1 6/2011 Lehnert et al.
2011/0233987 A1 9/2011 Maushart et al.
2011/0266070 A1 11/2011 Scott et al.
2012/0043138 A1 2/2012 Myers et al.
2012/0138370 A1 * 6/2012 Mukhopadhyay ..... B22F 7/06 175/428
2012/0160573 A1 6/2012 Myers et al.
2012/0175939 A1 7/2012 O'Neill et al.
2012/0241224 A1 * 9/2012 Qian ..... B22F 5/00 175/428
2012/0279786 A1 11/2012 Cox
2013/0052481 A1 * 2/2013 Konyashin ..... B22D 19/14 428/679
2013/0092451 A1 * 4/2013 Mukhopadhyay ..... B01J 3/062 175/428
2013/0092452 A1 * 4/2013 Mukhopadhyay ..... B22F 7/062 175/428
2013/0221003 A1 * 8/2013 Carver ..... B65D 11/1873 220/200
2013/0322975 A1 12/2013 Tan et al.
2014/0110991 A1 4/2014 Sollami
2014/0175853 A1 6/2014 Warren
2014/0225418 A1 * 8/2014 Lachmann ..... E21C 35/183 299/104
2014/0240634 A1 8/2014 Matsuzaki
2014/0339879 A1 11/2014 Burton et al.
2014/0339883 A1 11/2014 Burton et al.
2015/0035342 A1 2/2015 Jonker et al.
2015/0114727 A1 4/2015 Heuser
2015/0176408 A1 * 6/2015 Latham ..... E21C 35/193 299/105
2015/0176409 A1 * 6/2015 Latham ..... E21C 35/183 299/104
2015/0240635 A1 8/2015 Lachmann et al.

(56) References Cited

U.S. PATENT DOCUMENTS

| | | | | |
|---|---|---|---|---|
| 2015/0314483 | A1* | 11/2015 | Miess | E01C 23/088 299/104 |
| 2016/0102550 | A1 | 4/2016 | Swope et al. | |
| 2016/0273356 | A1 | 9/2016 | Ojanen et al. | |
| 2016/0332269 | A1 | 11/2016 | Provins et al. | |

FOREIGN PATENT DOCUMENTS

| | | |
|---|---|---|
| CN | 202073564 | 12/2011 |
| CN | 203081445 | 7/2013 |
| GB | 1481278 | 7/1977 |
| GB | 2170843 | 8/1986 |
| GB | 2177144 | 1/1987 |
| GB | 2193740 | 2/1988 |
| WO | WO 2010/083015 | 7/2010 |
| WO | WO 2012/130870 | 10/2012 |
| WO | WO 2016/071001 | 5/2016 |

OTHER PUBLICATIONS

U.S. Appl. No. 14/273,360, Mar. 7, 2016, Office Action.
U.S. Appl. No. 14/273,360, May 18, 2016, Notice of Allowance.
U.S. Appl. No. 14/275,574, Apr. 6, 2016, Office Action.
U.S. Appl. No. 61/824,022, filed May 16, 2013, Burton et al.
U.S. Appl. No. 61/824,007, filed May 16, 2013, Burton et al.
U.S. Appl. No. 62/030,525, filed Jul. 29, 2014, Myers et al.
U.S. Appl. No. 14/811,699, filed Jul. 28, 2015, Myers et al.
U.S. Appl. No. 62/232,732, filed Sep. 25, 2015, Weaver et al.
U.S. Appl. No. 29/540,584, filed Sep. 25, 2015, Weaver.
U.S. Appl. No. 29/540,597, filed Sep. 25, 2015, Weaver.
International Search Report and Written Opinion from International Application No. PCT/US2014/037708 dated Oct. 30, 2014.
International Search Report and Written Opinion from International Application No. PCT/US2014/037381 dated Oct. 30, 2014.
International Search Report and Written Opinion from International Application No. PCT/US2015/027830 dated Jul. 14, 2015.
Roepke et al.; "Drag Bit Cutting Characteristics Using Sintered Diamond Inserts" Report of Investigations 8802; Bureau of Mines Report of Investigations/ 1983; (1983) 35 pages.
U.S. Appl. No. 14/273,360, Jun. 12, 2015, Office Action.
U.S. Appl. No. 14/273,360, Oct. 22, 2015, Office Action.
Advisory Action received for U.S. Appl. No. 14/275,574 dated Mar. 9, 2017.
Final Office Action for U.S. Appl. No. 14/275,574 dated Nov. 29, 2016.
Non-Final Office Action received for U.S. Appl. No. 14/275,574 dated Apr. 7, 2017.
Non-Final Office for U.S. Appl. No. 29/555,279 dated Mar. 24, 2017.
Notice of Allowance received for U.S. Appl. No. 29/555,269 dated Apr. 6, 2017.
Supplemental Notice of Allowance for U.S. Appl. No. 14/273,360 dated Aug. 10, 2016.
U.S. Appl. No. 13/070,636, filed Mar. 24, 2011.
U.S. Appl. No. 14/273,360, filed May 8, 2014.
U.S. Appl. No. 29/555,269, filed Feb. 19, 2016.
U.S. Appl. No. 29/555,279, filed Feb. 19, 2016.
U.S. Appl. No. 29/555,281, filed Feb. 19, 2016.
Non-Final Office Action for U.S. Appl. No. 15/238,486 dated Aug. 17, 2017.
Notice of Allowance for U.S. Appl. No. 29/540,584 dated May 8, 2017.
Notice of Allowance for U.S. Appl. No. 29/540,597 dated May 8, 2017.
Notice of Allowance received for U.S. Appl. No. 29/555,281 dated Apr. 12, 2017.
Supplemental Notice of Allowance for U.S. Appl. No. 29/540,597 dated Jun. 1, 2017.
Supplemental Notice of Allowance for U.S. Appl. No. 29/555,269 dated Apr. 28, 2017.
Supplemental Notice of Allowance for U.S. Appl. No. 29/555,281 dated Jun. 12, 2017.
Issue Notification for U.S. Appl. No. 29/540,584 dated Sep. 14, 2017.
Issue Notification for U.S. Appl. No. 29/540,597 dated Sep. 6, 2017.
Issue Notification for U.S. Appl. No. 29/555,279 dated Jan. 10, 2018.
Non-Final Office Action for U.S. Appl. No. 14/811,699 dated Nov. 29, 2017.
Non-Final Office Action for U.S. Appl. No. 15/266,355 dated Jan. 8, 2018.
Notice of Allowance for U.S. Appl. No. 14/275,574 dated Jan. 24, 2018.
Notice of Allowance for U.S. Appl. No. 14/275,574 dated Sep. 26, 2017.
Notice of Allowance for U.S. Appl. No. 29/555,279 dated Aug. 31, 2017.
Notice of Allowance for U.S. Appl. No. 29/555,281 dated Jan. 4, 2018.
Supplemental Notice of Allowability for U.S. Appl. No. 29/555,279 dated Jan. 2, 2018.
Supplemental Notice of Allowance for U.S. Appl. No. 29/540,584 dated Sep. 7, 2017.
Supplemental Notice of Allowance for U.S. Appl. No. 29/540,597 dated Aug. 25, 2017.
Supplemental Notice of Allowance for U.S. Appl. No. 29/555,281 dated Feb. 9, 2018.
Final Office Action for U.S. Appl. No. 15/238,486 dated Feb. 26, 2018.
Notice of Allowance for U.S. Appl. No. 29/555,281 dated May 16, 2018.
Supplemental Notice of Allowance for U.S. Appl. No. 29/555,281 dated Jun. 4, 2018.
Advisory Action for U.S. Appl. No. 14/811,699 dated Oct. 22, 2018.
Advisory Action for U.S. Appl. No. 15/266,355 dated Oct. 11, 2018.
Final Office Action for U.S. Appl. No. 14/811,699 dated Jul. 10, 2018.
Final Office Action for U.S. Appl. No. 15/266,355 dated Jul. 25, 2018.
Issue Notification for U.S. Appl. No. 29/555,281 dated Aug. 29, 2018.
Non-Final Office Action for U.S. Appl. No. 15/266,355 dated Nov. 29, 2018.
Notice of Allowance for U.S. Appl. No. 14/275,574 dated Jun. 15, 2018.
Notice of Allowance for U.S. Appl. No. 14/275,574 dated Oct. 11, 2018.
Notice of Allowance for U.S. Appl. No. 15/238,486 dated Jun. 20, 2018.
Notice of Allowance for U.S. Appl. No. 15/238,486 dated Oct. 10, 2018.
Supplemental Notice of Allowability for U.S. Appl. No. 14/275,574 dated Oct. 31, 2018.
Supplemental Notice of Allowance for U.S. Appl. No. 15/238,486 dated Jun. 27, 2018.
U.S. Appl. No. 14/275,574, filed May 12, 2014.
Non-Final Office Action for U.S. Appl. No. 14/811,699 dated Jan. 4, 2019.
Notice of Allowance for U.S. Appl. No. 15/238,486 dated Jan. 28, 2019.
Notice of Allowance for U.S. Appl. No. 14/275,574 dated Feb. 12, 2019.
Final Office Action for U.S. Appl. No. 15/266,355 dated May 9, 2019.
Non-Final Office Action for U.S. Appl. No. 16/406,673 dated Jun. 27, 2019.
Notice of Allowance for U.S. Appl. No. 14/811,699 dated May 1, 2019.
Supplemental Notice of Allowance for U.S. Appl. No. 14/275,574 dated May 21, 2019.
U.S. Appl. No. 16/406,673, filed May 8, 2019.

(56) References Cited

OTHER PUBLICATIONS

Issue Notification for U.S. Appl. No. 15/238,486 dated May 22, 2019.
Issue Notification for U.S. Appl. No. 14/275,574 dated May 29, 2019, Issue Date: Jun. 18, 2019.

* cited by examiner

CUTTING TOOL ASSEMBLIES INCLUDING SUPERHARD WORKING SURFACES, MATERIAL-REMOVING MACHINES INCLUDING CUTTING TOOL ASSEMBLIES, AND METHODS OF USE

BACKGROUND

Milling and grinding machines are commonly used in various applications and industries, such as mining, asphalt and pavement removal and installation, and others. Such machines may remove material at desired locations. In some applications, material may be removed to facilitate repair or reconditioning of a surface. One example includes removing a portion or a layer of a paved road surface to facilitate repaving. In some instances, the removed material also may be valuable. For example, removed asphalt may be reprocessed and reused. Similarly, in mining operations, removed material may include valuable or useful constituents.

Conventional machines include cutting tools that may cut or grind target material. Typically, such cutting tools are mounted on a rotating drum assembly and engage (e.g., cut and/or grind) the target material as the drum assembly rotates. Failure of the cutting tools may, in turn, lead to the failure of the drum assembly and/or interruptions in operation thereof.

Therefore, manufacturers and users of cutting tools continue to seek improved cutting tools to extend the useful life of drum assemblies and/or reduce or eliminate interruptions in operation thereof.

SUMMARY

Embodiments of the invention are directed to cutting tool assemblies, material-removing machines that include cutting tool assemblies, and methods of use and operation thereof. In some embodiments, the cutting tool assemblies described herein may be used in material-removing machines that may remove a target material, such as a portion or a layer of a paved road surface. For example, a material-removing machine may include a rotary drum assembly, and the cutting tool assemblies may be mounted to or on the rotary drum assembly. Furthermore, as the material-removing machine rotates the rotary drum assembly, the cutting tool assemblies may engage and cut, grind, or otherwise fail the target material, which may be subsequently removed (e.g., by the rotary drum assembly of the material-removing machine).

In an embodiment, a cutting tool assembly is disclosed. The cutting tool assembly is configured for mounting on a rotary drum assembly and removing a target material. For example, the cutting tool assembly includes a support block having a mounting end and a working end. The mounting end is sized and configured to attach to the rotary drum assembly. In addition, the cutting tool assembly includes a cutting element secured to the working end of the support block. The cutting element has a working surface that includes a superhard material. Also, the cutting tool assembly includes a shield secured to the working end of the support block. The shield is sized and configured to protect at least a portion of the working end from abrasion and/or wear during operation of the cutting tool assembly.

Additional or alternative embodiments may include another cutting tool assembly for removing a target material. Such cutting tool assembly includes a support block that has a mounting end and a working end. The mounting end is sized and configured to attach to a material-removing machine. Moreover, the cutting tool assembly includes a shield secured to the working end of the support block and sized and configured to protect at least a portion of the working end from wear or abrasion. The cutting tool assembly also includes a cutting element secured to the shield and having a working surface that includes superhard material.

In an embodiment, a rotary drum assembly for removing a target material is disclosed. The rotary drum assembly includes a drum body having at least one of any of the disclosed cutting tool assemblies mounted thereto.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1A:
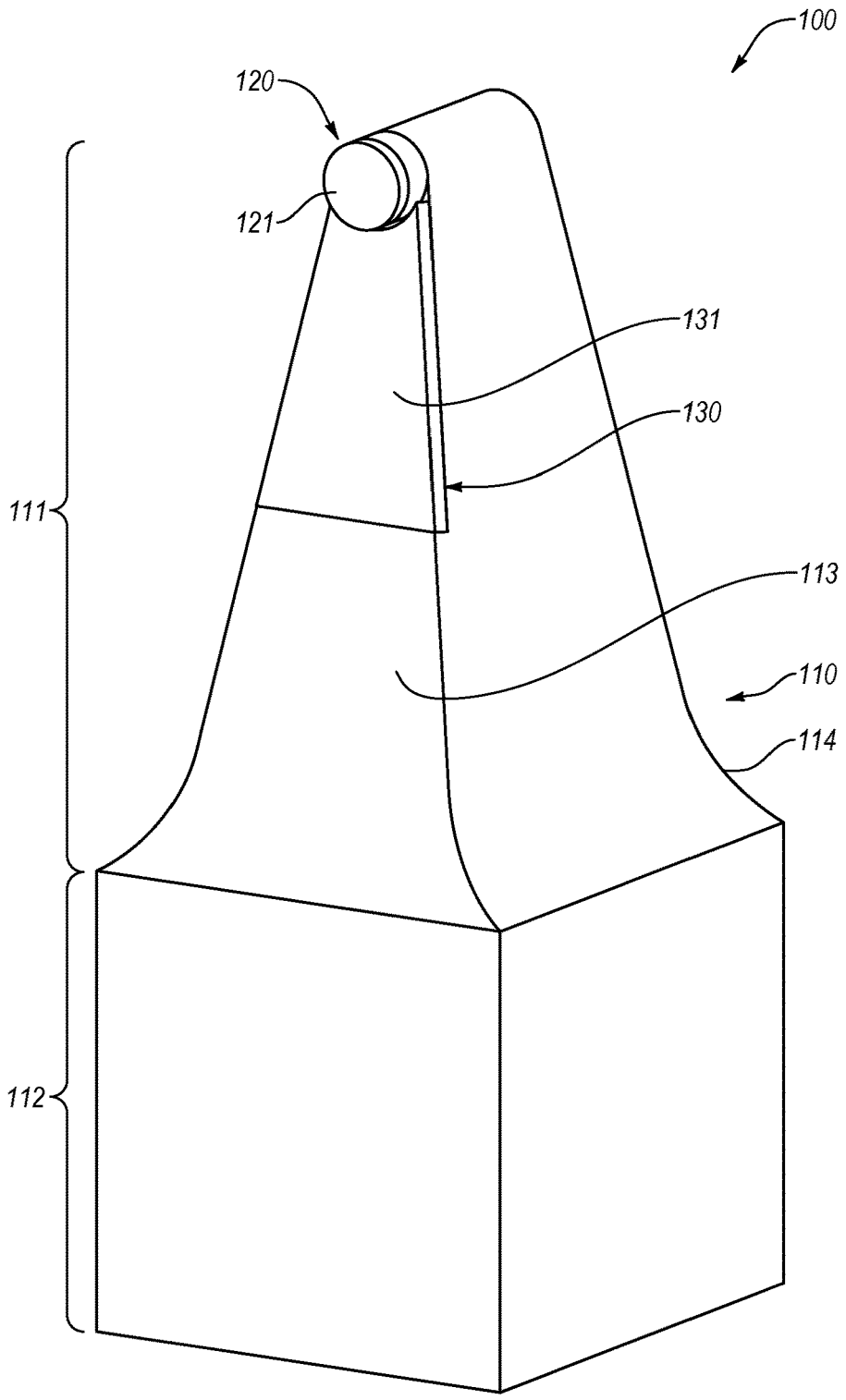
FIG. 1A is an isometric view of a cutting tool assembly according to an embodiment of the invention.

Embodiments of the invention are directed to cutting tool assemblies, material-removing machines that include cutting tool assemblies, and methods of use and operation thereof. In some embodiments, the cutting tool assemblies described herein may be used in material-removing machines that may remove target material, such as a portion or a layer of a paved road surface. For example, a material-removing machine may include a rotary drum assembly, and the cutting tool assemblies may be mounted to or on the rotary drum assembly. Furthermore, as the material-removing machine rotates the rotary drum assembly, the cutting tool assemblies may engage and cut, grind, or otherwise fail the target material, which may be subsequently removed (e.g., by the rotary drum assembly of the material-removing machine).

In an embodiment, the cutting tool assemblies may include one or more superhard working surfaces that may engage the target material. As used herein, "superhard material" includes materials exhibiting a hardness that is at least equal to the hardness of tungsten carbide (i.e., a portion of or the entire working surface may have a hardness that exceeds the hardness of tungsten carbide). In any of the embodiments disclosed herein, the cutting tool assemblies and the cutting elements may include one or more superhard materials, such as polycrystalline diamond, polycrystalline cubic boron nitride, silicon carbide, tungsten carbide, or any combination of the foregoing superhard materials. For example, a cutting element may include a substrate and a superhard material bonded to the substrate, as described in further detail below. The superhard material may form or define the working surface.

The cutting tool assemblies may include a support block. For example, the working surface may be formed on or secured to the support block (e.g., the working surface may be formed on a cutting element that is secured to the support block). In some embodiments, the cutting tool assemblies may include a shield configured to protect at least a portion of the support block from wear and/or abrasion that the support block may otherwise experience during operation. In some embodiments, the shield may include material that is harder and/or tougher (e.g., more abrasion resistant) than the material from which the support block is made. Additionally or alternatively, the shield may be removably attached to the support block. A removable shield may be removed and/or replaced when suitable (e.g., after a certain amount of wear of the shield), thereby maintaining appropriate integrity of the shield during operation and providing protection to the support block.

In some embodiments, the support block may be shaped, sized, or otherwise configured in a manner that may reduce wear thereof during operation and/or may improve flow and/or efficiency of cuttings or failed material relative to the support block. For example, the support block may be shaped in a manner that reduces drag and/or engagement thereof with the target material. Furthermore, in alternative or additional embodiments, the support block may be configured in a manner that reduces contact of the support block with the failed material (e.g., as the failed material moves past the support block). As described above, in some embodiments, the failed material may be channeled away from the target material by the rotary drum assembly of the material-removing system, as described in further detail below. Moreover, the cutting tool assemblies may be secured to the rotary drum assembly and may come into contact with the failed material, for instance, as the failed material is moved by the rotary drum assembly. In an embodiment, the support block of the cutting tool assembly may be shaped and sized in a manner that minimizes or reduces contact of the support block with the failed material during removal thereof, thereby extending useful life of the support block and of the cutting tool assembly.

FIG. 1A illustrates an embodiment of a cutting tool assembly 100. For example, the cutting tool assembly 100 includes a support block 110 and a cutting element 120 secured to the support block 110. More specifically, in some embodiments, the support block 110 may include a working end 111 and a mounting end 112 (i.e., the working end 111 may be configured to engage and fail the target material). The cutting element 120 may be mounted or secure to the support block 110 at the working end 111 thereof.

As described below in further detail, the cutting element 120 may include a superhard working surface 121. The superhard working surface 121 may be sized and configured to engage, cut, scrape, or otherwise cause the target material to fail. For example, the superhard working surface 121 may include a cutting edge that may define at least a portion of the perimeter of the superhard working surface 121. Particularly, the cutting edge may facilitate entry or penetration of the cutting element 120 into the target material and subsequent failing and/or removal thereof.

In some embodiments, the superhard working surface 121 may include a chamfered periphery. In other words, a chamfer may extend from at least a portion of the superhard working surface 121 to a peripheral surface of the cutting element 120. As such, the chamfer may form two or more cutting edges (e.g., a cutting edge formed at the interface between the working surface 121 and the chamfer and another cutting edge formed at the interface between the chamfer and the peripheral surface of the cutting element 120).

In some embodiments, the superhard working surface 121 may include superhard material. As used herein, "superhard material" includes materials exhibiting a hardness that is at least equal to the hardness of tungsten carbide (i.e., a portion or the entire working surface may have a hardness that exceeds the hardness of tungsten carbide). In any of the embodiments disclosed herein, the cutting assemblies and the cutting elements may include one or more superhard materials, such as polycrystalline diamond, polycrystalline cubic boron nitride, silicon carbide, tungsten carbide, or any combination of the foregoing superhard materials. For example, a cutting element may include a substrate and a superhard material bonded to the substrate, as described in further detail below.

In some embodiments, the superhard working surface 121 may be formed or defined by a superhard table that may be attached to a substrate. In an embodiment, the substrate may be attached to the support block 110 and/or to shield (described below in further detail). Alternatively, the superhard table may be attached directly to the support block 110 and/or to the shield. Moreover, in some embodiments, the support block 110 and/or the shield may form the substrate (e.g., the support block 110 and/or the shield may include suitable material for bonding the superhard table thereto, such as tungsten carbide).

In an embodiment, the superhard table may comprise polycrystalline diamond and the substrate may comprise cobalt-cemented tungsten carbide. Furthermore, in any of the embodiments disclosed herein, the polycrystalline diamond table may be leached to at least partially remove or substantially completely remove a metal-solvent catalyst (e.g., cobalt, iron, nickel, or alloys thereof) that was used to initially sinter precursor diamond particles to form the polycrystalline diamond. In another embodiment, an infiltrant used to re-infiltrate a preformed leached polycrystalline diamond table may be leached or otherwise have a metallic infiltrant removed to a selected depth from a working surface. Moreover, in any of the embodiments disclosed herein, the polycrystalline diamond may be un-leached and include a metal-solvent catalyst (e.g., cobalt, iron, nickel, or alloys thereof) that was used to initially sinter the precursor diamond particles that form the polycrystalline diamond and/or an infiltrant used to re-infiltrate a preformed leached polycrystalline diamond table. Examples of methods for fabricating the superhard tables and superhard materials and/or structures from which the superhard tables and elements may be made are disclosed in U.S. Pat. Nos. 7,866,418; 7,998,573; 8,034,136; and 8,236,074; the disclosure of each of the foregoing patents is incorporated herein, in its entirety, by this reference.

The diamond particles that may be used to fabricate the superhard table in a high-pressure/high-temperature process ("HPHT)" may exhibit a larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger size (e.g., 70 μm, 60 μm, 50 μm, 40 μm, 30 μm, 20 μm, 15 μm, 12 μm, 10 μm, 8 μm) and another portion exhibiting at least one relatively smaller size (e.g., 15 μm, 12 μm, 10 μm, 8 μm, 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger size between about 10 μm and about 40 μm and another portion exhibiting a relatively smaller size between about 1 μm and 4 μm. In another embodiment, the diamond particles may include a portion exhibiting the relatively larger size between about 15 μm and about 50 μm and another portion exhibiting the relatively smaller size between about 5 μm and about 15 μm. In another embodiment, the relatively larger size diamond particles may have a ratio to the relatively smaller size diamond particles of at least 1.5. In some embodiments, the diamond particles may comprise three or more different sizes (e.g., one relatively larger size and two or more relatively smaller sizes), without limitation. The resulting polycrystalline diamond formed from HPHT sintering the aforementioned diamond particles may also exhibit the same or similar diamond grain size distributions and/or sizes as the aforementioned diamond particle distributions and particle sizes. Additionally, in any of the embodiments disclosed herein, the superhard cutting elements may be free-standing (e.g., substrateless) and/or formed from a polycrystalline diamond body that is at least partially or fully leached to remove a metal-solvent catalyst initially used to sinter the polycrystalline diamond body.

As noted above, the superhard table may be bonded to the substrate. For example, the superhard table comprising polycrystalline diamond may be at least partially leached and bonded to the substrate with an infiltrant exhibiting a selected viscosity, as described in U.S. patent application Ser. No. 13/275,372, entitled "Polycrystalline Diamond Compacts, Related Products, And Methods Of Manufacture," the entire disclosure of which is incorporated herein by this reference. In an embodiment, an at least partially leached polycrystalline diamond table may be fabricated by subjecting a plurality of diamond particles (e.g., diamond particles having an average particle size between 0.5 μm to about 150 μm) to an HPHT sintering process in the presence of a catalyst, such as cobalt, nickel, iron, or an alloy of any of the preceding metals to facilitate intergrowth between the diamond particles and form a polycrystalline diamond table comprising bonded diamond grains defining interstitial regions having the catalyst disposed within at least a portion of the interstitial regions. The as-sintered polycrystalline diamond table may be leached by immersion in an acid or subjected to another suitable process to remove at least a portion of the catalyst from the interstitial regions of the polycrystalline diamond table, as described above. The at least partially leached polycrystalline diamond table includes a plurality of interstitial regions that were previously occupied by a catalyst and form a network of at least partially interconnected pores. In an embodiment, the sintered diamond grains of the at least partially leached polycrystalline diamond table may exhibit an average grain size of about 20 μm or less. Subsequent to leaching the polycrystalline diamond table, the at least partially leached polycrystalline diamond table may be bonded to a substrate in an HPHT process via an infiltrant with a selected viscosity. For example, an infiltrant may be selected that exhibits a viscosity that is less than a viscosity typically exhibited by a cobalt cementing constituent of typical cobalt-cemented tungsten carbide substrates (e.g., 8% cobalt-cemented tungsten carbide to 13% cobalt-cemented tungsten carbide).

Additionally or alternatively, the superhard table may be a polycrystalline diamond table that has a thermally-stable region, having at least one low-carbon-solubility material disposed interstitially between bonded diamond grains thereof, as further described in U.S. patent application Ser. No. 13/027,954, entitled "Polycrystalline Diamond Compact Including A Polycrystalline Diamond Table With A Thermally-Stable Region Having At Least One Low-Carbon-Solubility Material And Applications Therefor," the entire disclosure of which is incorporated herein by this reference. The low-carbon-solubility material may exhibit a melting temperature of about 1300° C. or less and a bulk modulus at 20° C. of less than about 150 GPa. The low-carbon-solubility, in combination with the high diamond-to-diamond bond density of the diamond grains, may enable the low-carbon-solubility material to be extruded between the diamond grains and out of the polycrystalline diamond table before causing the polycrystalline diamond table to fail during operations due to interstitial-stress-related fracture.

In some embodiments, the polycrystalline diamond, which may form the superhard table, may include bonded-together diamond grains having aluminum carbide disposed interstitially between the bonded-together diamond grains, as further described in U.S. patent application Ser. No. 13/100,388, entitled "Polycrystalline Diamond Compact Including A Polycrystalline Diamond Table Containing Aluminum Carbide Therein And Applications Therefor," the entire disclosure of which is incorporated herein by this reference.

In additional or alternative embodiments, the cutting tool assembly 100 may include a shield 130, which may be sized and configured to protect the support block 110 from abrasion, damage, wear, etc., during operation of the cutting tool assembly 100. In some embodiments, the shield 130 may be secured to the working end 111 of the support block 110 below the cutting element 120. For example, the shield 130 may be fastened, brazed, or otherwise selectively (e.g., removably) secured to the support block 110. Alternatively, the shield 130 may be non-removably secured to the support block 110 and/or may be integrated therewith.

In some embodiments, the shield 130 may include abrasion and wear resistant material. More specifically, material of the shield 130 may be more abrasion and/or wear resistant than the material of the support block 110. In some instances, the shield 130 may include material that is harder than the material of the support block 110. For example, the support block 110 may include steel, such as stainless steel or similar material, which may have hardness of about 15 HRC to 65 HRC, while the shield 130 may have a hardness of cemented tungsten carbide or harder (e.g., tungsten carbide, cubic boron nitride, diamond, and the like). In another example, the support block 110 may comprise steel (e.g., annealed or tempered steel) and the shield 130 may comprise harder steel, such as heat-treated or hardened steel. In one or more embodiments, the support block 110 may be manufactured from powdered material, such as powdered matrix materials (e.g., by compressing such materials into a shape desired for the support block 110 and heating the compressed material in a manner that bonds the matrix together), as described in further detail in U.S. Pat. Nos. 8,047,260; 4,484,644; 5,090,491; and 6,089,123. Disclosures of each of the above-referenced patents are incorporated herein in their entireties by this reference. In an embodiment, the matrix or green body may be sintered by infiltrating a binder, such as copper, silver, alloys thereof, etc.

Furthermore, as noted above, the shield 130 may be removable and/or replaceable. As such, in some instances, the shield 130 also may be sacrificial. In other words, any suitable material for the shield 130 may be selected based on intended replacement of the shield 130 (e.g., the material for the shield 130 may be selected based on cost thereof). Consequently, in some embodiments, the shield 130 may include materials that have lower hardness and/or abrasion resistance than the material of the support block 110. Suitable material for the shield 130 may include rubber, plastic, etc. As the shield 130 wears (e.g., beyond usable state), the shield 130 may be replaced with another shield 130. Replacement of the shield 130 may prevent damage or wear of the support block 110. In any event, the shield 130 may protect the support block 110 from damage, thereby extending useful life thereof as well as of the cutting tool assembly 100.

As described above, in some embodiments, the shield 130 may be secured to the support block 110 at the working end 111 thereof. In one embodiment, the shield 130 may be brazed to the support block 110. In one embodiment, the shield 130 may be secured near the cutting element 120 and may protect or shield a portion of the cutting element 120 that secures the cutting element 120 to the support block 110. Likewise, the shield 130 may shield at least a portion of the working end 111 of the support block 110 that facilitates attachment of the cutting element 120 to the support block 110. For example, the support block 110 may include at least a partial pocket or recess that may secure the cutting element 120. The shield 130 may abut the cutting element 120 and/or such pocket or recess in the working end 111 of the support block 110 in a manner that protects attachment of the cutting element 120 to the support block 110.

It should be appreciated that in some instances, an unprotected recess or other location securing the cutting element 120 to the support block 110 may be exposed to abrasion and wear, which may result in loosening, dislodging, or detachment of the cutting element 120 from the support block 110. Accordingly, protecting at least near the location of the attachment of the cutting element 120 to the support block 110 may facilitate continuous attachment thereof during operation of the cutting tool assembly 100, thereby increasing the useful life of the cutting tool assembly 100.

Generally, the shield 130 may have any shape, size, and configuration suitable for protecting the support block 110 and/or the cutting element 120 of the cutting tool assembly 100, which may vary from one embodiment to the next. In some embodiments, the shield 130 may have a substantially planar shielding face 131, which may generally face in the same direction as the superhard working surface 121 of the cutting element 120. For example, the shield 130 may be configured as a plate that may be attached to the support block 110. In additional or alternative embodiments, the shielding face of the shield 130 may have any suitable configurations and may be nonplanar, interrupted, formed from multiple segments, and the like. Moreover, the shield 130 may protect other faces and/or areas of the support block 110 (e.g., the shield may at least partially wrap around the working end 111 of the support block 110).

In an embodiment, the shielding face 131 of the shield 130 may be approximately flush or planar with one or more faces of the support block 110 (e.g., the shielding face 131 may be flush with a front face 113). Alternatively, however, the shielding face 131 of the shield 130 may protrude beyond one or more faces of the support block 110. For example, the shielding face 131 of the shield 130 may protrude beyond the front face 113 of the support block 110.

In some embodiments, the shield 130 may be shaped in a manner that accommodates close positioning of the shield 130 to the cutting element 120. For example, as described below in further detail, the cutting element 120 may have an approximately cylindrical shape. In some embodiments, to accommodate the cylindrical shape of the cutting element 120, the shield 130 may have a corresponding cutout or notch formed therein, which may approximate the exterior shape of the cutting element 120. Consequently, at least a portion of the cutting element 120 may be surrounded by or adjacent to the shield 130, which among other things may protect the connection or attachment between the cutting element 120 and support block 110.

In some embodiments, the working end 111 of the support block 110 may be tapered. For example, the working end 111 of the support block 110 may exhibit a generally pyramidal shape, a generally frustoconical shape, a generally conical shape, or any other generally tapered shape, having a wider portion thereof located near and/or attaching to the mounting end 112 of the support block 110. In an embodiment, the cutting element 120 may be secured to a narrower portion of the tapered working end 111. The taper of the working end 111 may reduce otherwise undesirable contact of the support block 110 with the target material, thereby reducing drag and wear of at least a portion of the support block 110 that moves through the target material.

In at least one embodiment, the support block 110 also may include a transition radius 114 that may extend between a tapered portion of the working end 111 and the mounting end 112. The radius 114 may produce a smooth transition between the peripheral surface of the mounting end 112 and a peripheral surface of the tapered portion of the working end 111. It should be appreciated, however, that in additional or alternative embodiments, the support block 110 may include any number of suitable shapes that may facilitate attachment of the cutting element 120 as well as engagement of the cutting element 120 with the target material.

Figure 1B:
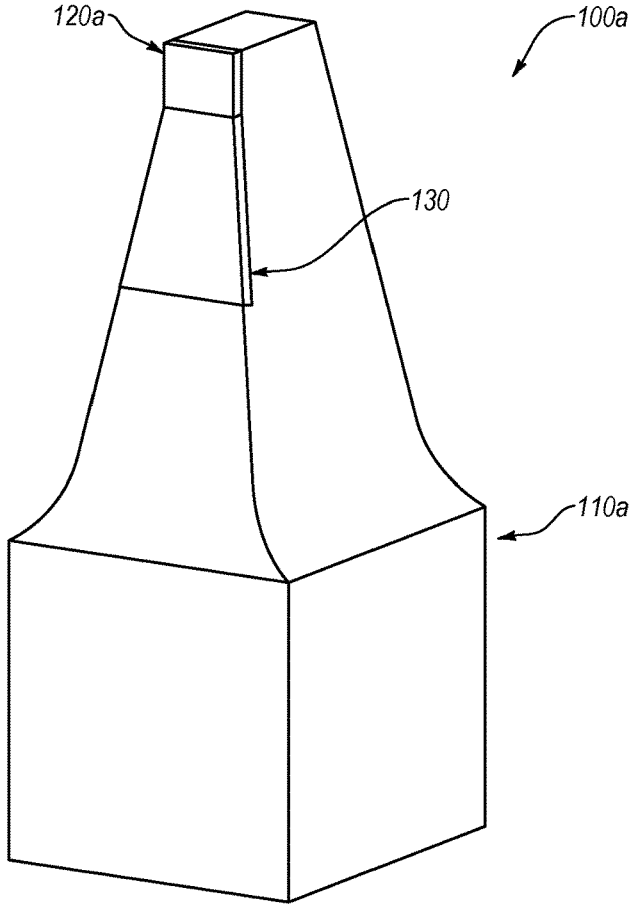
FIG. 1B is an isometric view of a cutting tool assembly according to an embodiment of the invention.

While the cutting tool assembly 100 is described above as including the cutting element 120 that has an approximately cylindrical shape, it should be appreciated that the cutting element may have any number of suitable shapes, which may be configured to engage, fail, and remove the target material, and which may include any number of cutting edges and/or working surfaces thereon. FIG. 1B, for example, illustrates a cutting tool assembly 100*a* that includes a cuboid cutting element 120*a* secured to a support block 110*a*. Except as otherwise described herein, the cutting tool assembly 100*a* and its materials, elements, or components may be similar to or the same as cutting tool assembly 100 (FIG. 1A) and its respective materials, elements and components. For example, the cutting tool assembly 100*a* may include a shield 130*a* secured to the support block 110*a*, which may be similar to or the same as the shield 130 of the cutting tool assembly 100 (FIG. 1A).

Any of the cutting tool assemblies described herein may include one or more cutting elements, each of which may have any suitable shape and size. Suitable shapes for a cutting element include but are not limited to arcuate, oval, and polygonal. Moreover, the cutting tool assembly may include any number of cutting elements secured to a support block, and the cutting elements may have any number of suitable orientations, which in some instances may facilitate indexing of the cutting tool assembly. In other words, as one or more of the cutting elements of the cutting tool assembly wear and/or become unusable, the cutting tool assembly may be indexed or reoriented (e.g., rotated) in a manner that provides another cutting element for engagement with the target material.

Figure 2A:
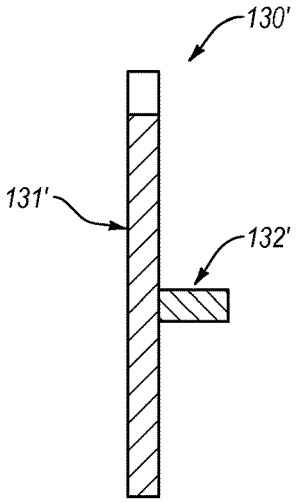
FIG. 2A is a cross-sectional view of a shield according to an embodiment of the invention.

As described above, the shield may have any number of suitable shapes and may connect or attach to the support block in any number of suitable ways. FIG. 2A illustrates one embodiment of a shield 130' that has a plate-like configuration. More specifically, the shield 130' includes an approximately planar shielding face 131' that may be aligned with a face of a support block. Moreover, the shield 130' includes a mounting post 132', which may be secured within a recess in a support block. For example, the support block may include a recess sized and/or shaped to correspond with the mounting post 132'. Particularly, in an embodiment, the mounting post 132' may be press-fitted, welded, soldered, brazed, combinations thereof, or otherwise secured within a recess (e.g., in a manner that secures the shield 130') to the support block.

Figure 2B:
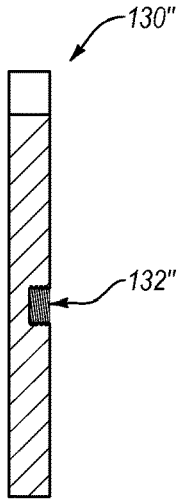
FIG. 2B is a cross-sectional view of a shield according to another embodiment of the invention.

In some embodiments, the shield may be fastened to the support block. FIG. 2B illustrates one example of a shield 130" that is configured for attachment to the support block with one or more threaded fasteners. Specifically, the shield 130" may include a threaded hole 132", which may accept a threaded shaft such as a screw or bolt that may secure the shield 130" to the support block. It should be appreciated, however, that in additional or alternative embodiments, the shield 130" may include a threaded male member that may pass into or through the support block and may be fastened thereto. Furthermore, the shield 130" may be used in combination with other methods of attachment and/or attachment elements or structures, which may secure the shield 130" to one or more portions of the cutting tool assembly (e.g., to the support block).

For example, the support block may include a through hole or opening and the threaded male member may pass through such opening and may be secured to the support block with one or more nuts. In some instances, the support block may include a threaded hole and the threaded male member of the shield may be screwed into the threaded hole in the support block. In any event, the shield may be fastened to the support block with any number of suitable fasteners that may allow removal and/or replacement of the shield, as described above.

Figure 3B:
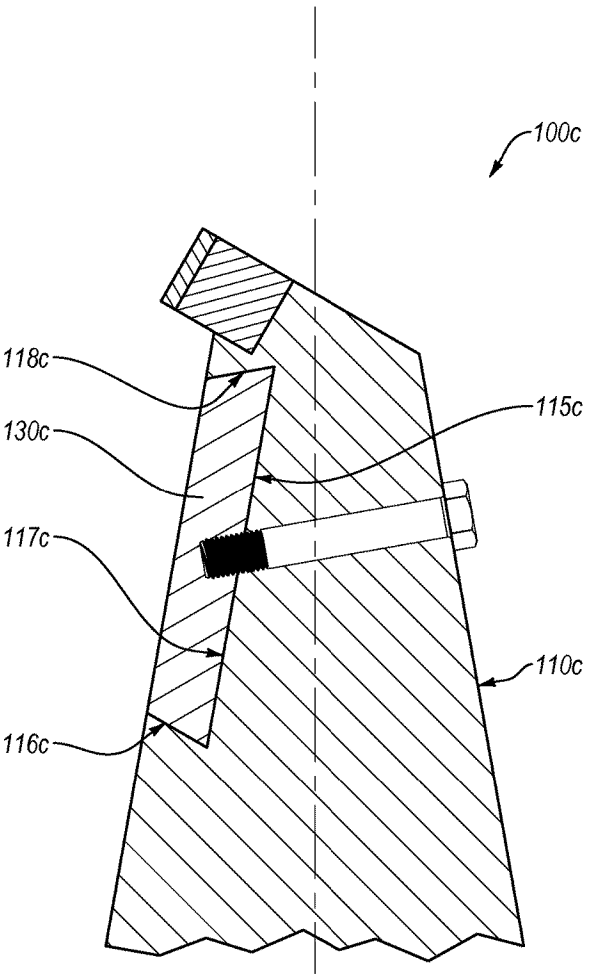
FIG. 3B is a partial cross-sectional view of a cutting tool assembly according to another embodiment of the invention.
Figure 3A:
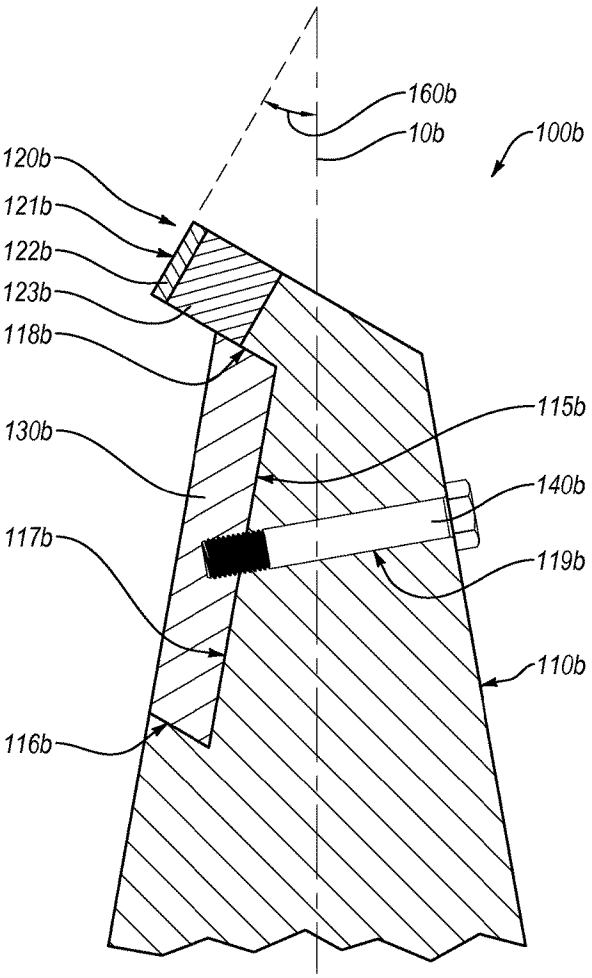
FIG. 3A is a partial cross-sectional view of a cutting tool assembly according to an embodiment of the invention.

Also, the location and/or orientation of the shield on the support block may be achieved in any number of suitable ways. Moreover, in addition to or in lieu of fastening the shield to the support block, the shield may be secured by at least a portion of the support block. For example, as shown in FIG. 3A, a cutting tool assembly 100*b* may have a support block 110*b* that includes a pocket 115*b* that may secure shield 130*b* therein. For example, the pocket 115*b* may orient and/or position the shield 130*b* relative to the support block 110*b*. Except as otherwise described herein, the cutting tool assembly 100*b* and its materials, elements, or components may be similar to or the same as any of the cutting tool assemblies 100, 100*a* (FIGS. 1A-1B) and their respective materials, elements and components. For example, the shield 130*b* may be similar to or the same as any of the shields 130, 130*a* (FIGS. 1A-1B).

In some embodiments, the pocket 115*b* may at least partially secure the shield 130*b* to the support block 110*b*. For example, the pocket 115*b* may include an undercutting portion, such as an angled side 116*b*. In an embodiment, the angled side 116*b* may form an acute angle with a back side 117*b* of the pocket 115*b*. Likewise, the shield 130*b* may have a corresponding tapered or beveled side that may contact the angled side 116*b* of the pocket 115*b*. As such, the angled side 116*b* may restrain the shield 130*b* from lateral movement (e.g., outward, away from the back side 117*b*).

In an embodiment, the pocket 115*b* may be defined by two opposing angled sides such as the angled side 116*b* and in angled side 118*b*. For example, the angled side 118*b* may form an obtuse angle relative to the backside 117*b* of the pocket 115*b*. Accordingly, the shield 130*b* may be inserted into the pocket 115*b* by sliding along the corresponding angled sides 116*b*, 118*b*. Furthermore, in some instances, the angled side 116*b* may be approximately parallel to the angled side 118*b*.

In an embodiment, the pocket 115*b* may be a partially open pocket. For example, the pocket 115*b* may be defined only by the backside 117*b* and opposing angled sides 116*b*, 118*b*. In other words, the pocket 115*b* may have open sides generally orthogonal to the opposing angled sides 116*b*, 118*b*. Thus, without additional restraint, the shield 130*b* may be unrestrained from movement within the pocket 115*b* along directions generally parallel to the opposing angled sides 116*b*, 118*b* and along the back side 117*b*. In alternative or additional embodiments, however, the pocket may be enclosed by three, four, or any suitable number of sides, which may restrain the shield 130*b* from movement within the pocket. In some embodiments, the support block may be formed around the shield, so as to mechanically lock the shield and/or bond the shield to the support block.

Also, as mentioned above, the shield 130*b* may be secured to the cutting tool assembly 100*b* with one or more fasteners, such as a threaded fastener 140*b*. For example, the support block 110*b* may include an opening 119*b* that may allow the threaded fastener 140*b* to pass therethrough. Hence, the threaded fastener 140*b* may pass into the pocket 115*b* and may be threaded into the shield 130*b*, thereby securing the shield 130*b* to the support block 110*b* and/or within the pocket 115*b*.

The cutting tool assembly 100*b* also may include a cutting element 120*b* secured to the support block 110*b*. In at least one embodiment, the cutting element 120*b* may have a superhard working surface 121*b*. For example, the cutting element 120*b* may include a superhard table 122*b* that may be bonded or otherwise secured to a substrate 123*b*. Similar to the cutting tool assembly 100 (FIG. 1A), the superhard working surface 121*b* and/or the cutting edge forming the perimeter thereof may engage and fail the target material. In some instances, the superhard working surface 121*b* may be substantially planar. In some embodiments superhard working surface 121*b* also may include a chamfer or radius that at least partially extends about or surrounds the superhard working surface 121*b*.

In an embodiment, the superhard working surface 121*b* may be oriented at a nonparallel angle relative to a longitudinal centerline 10*b*. For example, the plane in which the superhard working surface 121*b* lies may form an acute angle with the longitudinal centerline 10*b*, such as an acute negative angle 160*b*. Moreover, as described below in more detail, the cutting tool assembly 100*b* may attach to a rotary drum assembly in a manner that the longitudinal centerline 10*b* is approximately aligned with the center of rotation of the rotary drum assembly. In alternative embodiment, the longitudinal centerline 10*b* may be misaligned with the center of rotation of the rotary drum assembly. In any event, in an embodiment, the cutting tool assembly 100*b* may be secured to the rotary drum assembly in a manner that the superhard working surface 121*b* has a positive rake angle (i.e., measured counterclockwise from longitudinal centerline 10*b*). It should be appreciated, however, that this disclosure is not so limited. In some instances, the superhard working surface 121*b* may have a negative rake angle (i.e., measured clockwise from longitudinal centerline 10*b*).

As described above, the shield and the corresponding pocket may have any number of suitable configurations and sizes, which may vary from one embodiment to the next. FIG. 3B illustrates a cutting tool assembly 100*c* that includes a pocket 115*c*, which secures a shield 130*c* to the support block 110*c*. More specifically, the pocket 115*c* may include opposing angled sides 116*c*, 118*c* which may form acute angles relative to a backside 117*c*. In some examples, the acute angles formed between the angled sides 116*c*, 118*c* and the backside 117*c* may be approximately the same. Alternatively, the respective angles formed between the backside 117*c* and the angled sides 116*c*, 118*c* may be different from each other. Except as otherwise described herein, the cutting tool assembly 100*c* and its materials, elements, or components may be similar to or the same as any of the cutting tool assemblies 100, 100*a*, 100*b* (FIGS. 1A-1B, 3A) and their respective materials, elements and components.

The shield 130*c* may have corresponding angled or beveled sides that may at least partially contact one or more of the angled sides 116*c*, 118*c* of the pocket 115*c*. The angled sides 116*c*, 118*c* of the pocket 115*c* may cooperate with the corresponding angled sides of the shield 130*c* and may restrain movement of the shield 130*c* within the pocket 115*c*. In particular, angled sides 116*c*, 118*c* may prevent or limit movement of the shield 130*c* out of the pocket 115*c* (e.g., in a direction away from the back side 117*c*). In some examples, the pocket 115*c* may have at least one open side that may allow the shield 130*c* to slide into the pocket 115*c* (e.g., along the angled sides 116*c*, 118*c*).

Figure 3C:
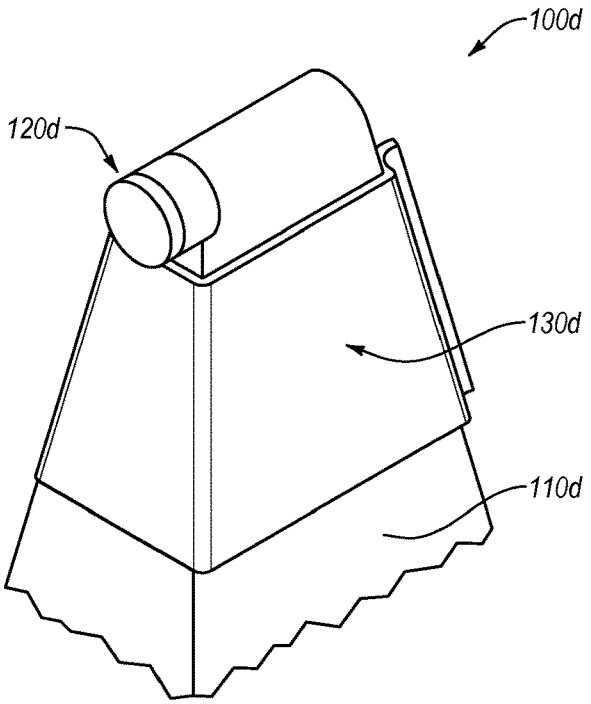
FIG. 3C is a partial isometric view of a cutting tool assembly according to yet another embodiment of the invention.

It may also be desirable to provide a shield that may be quickly and/or easily removed and replaced. For example, FIG. 3C illustrates a cutting tool assembly 100*d* that includes a removable shield 130*d* secured to a support block 110*d* (e.g., removable shield 130*d* may elastically deform around support block 110*d*). Except as otherwise described herein, the cutting tool assembly 100*d* and its materials, elements, or components may be similar to or the same as any of the cutting tool assemblies 100, 100*a*, 100*b*, 100*c* (FIGS. 1A-1B, 3A-3B) and their respective materials, elements and components. For example, the cutting tool assembly 100*d* may include a cutting element 120*d* secured to the support block 110*d* in a manner similar to the cutting element 120 is secured to the support block 110 (FIG. 1A).

In some embodiments, the shield 130*d* may at least partially wrap around or cover the support block 110*d*. For example, the shield 130*d* may cover two or three sides of the support block 110*d*. As such, the shield 130*d* may protect multiple sides of the support block 110*d*, thereby extending the useful life of the cutting tool assembly 100*d*. Additionally or alternatively, the shield may cover all of the sides of the support block 110*d* (e.g., wrapping all four sides of the support block 110*d*).

Furthermore, as noted above, the shield 130*d* may snap or mechanically lock about the support block 110*d*. As the shield 130*d* wears by a certain amount (e.g., beyond a useful state), the shield 130*d* may be removed from the support block 110*d* and replaced. While the particular shape and size of the shield 130*d* may vary from one embodiment to the next, it should be appreciated that, generally, the shield 130*d* may fit snugly about the support block 110*d*. Hence, the shape and size of the internal portion of the shield 130*d* may approximate the shape and size of at least a portion of the peripheral surface of the support block 110*d*.

Figure 3D:
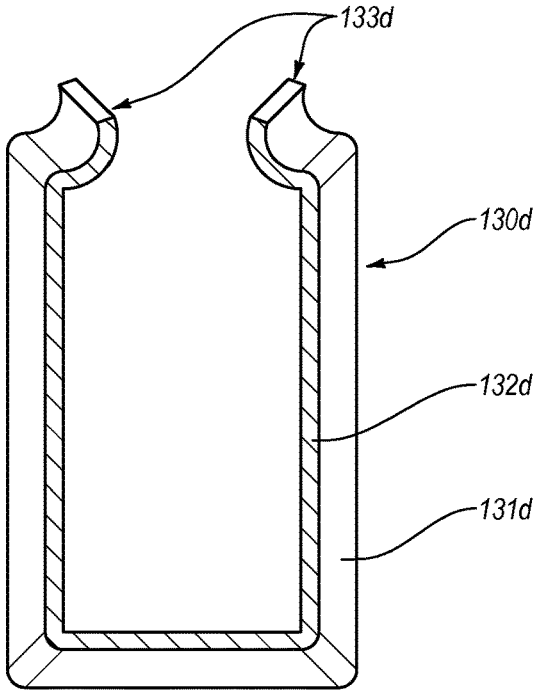
FIG. 3D is a cross-sectional view of a shield according to an embodiment of the invention.

FIG. 3D illustrates one embodiment of the shield 130*d*. More specifically, the shield 130*d* may have tapered walls that form shielding faces 131*d*. For example, the shield 130*d* may include tapered walls 132*d* that may form the inner and outer peripheral surfaces of the shield 130*d*. The inner peripheral surface of the shield 130*d* may approximate the outer peripheral surface of the support block that secures the shield 130*d*. In an embodiment, the inner peripheral surface may correspond with the angled walls of the support block. Embodiments also may include inner peripheral surface shaped and sized to at least partially wrap around support blocks of other various shapes and sizes.

The shield 130*d* also may include snap-on features that may secure the shield 130*d* to the support block. For example, the shield 130*d* may include snap-on features 133*d* that may extend from opposing portions of the walls shielding face 131*d*. The shield 130*d* may include flexible and resilient material that may allow the snap-on features 133*d* to be deflected away from and refracted toward their original positions. Consequently, the walls 132*d* and/or the snap-on features 133*d* may be moved outward such that the inside of the shield 130*d* may accept a corresponding portion of the support block. After the support block has been inserted into the shield 130*d* (or the shield 130*d* placed about the support block), the walls 132*d* and/or the snap-on features 133*d* may retract toward their original positions, thereby securing the shield 130*d* to the support block.

Figure 4B:
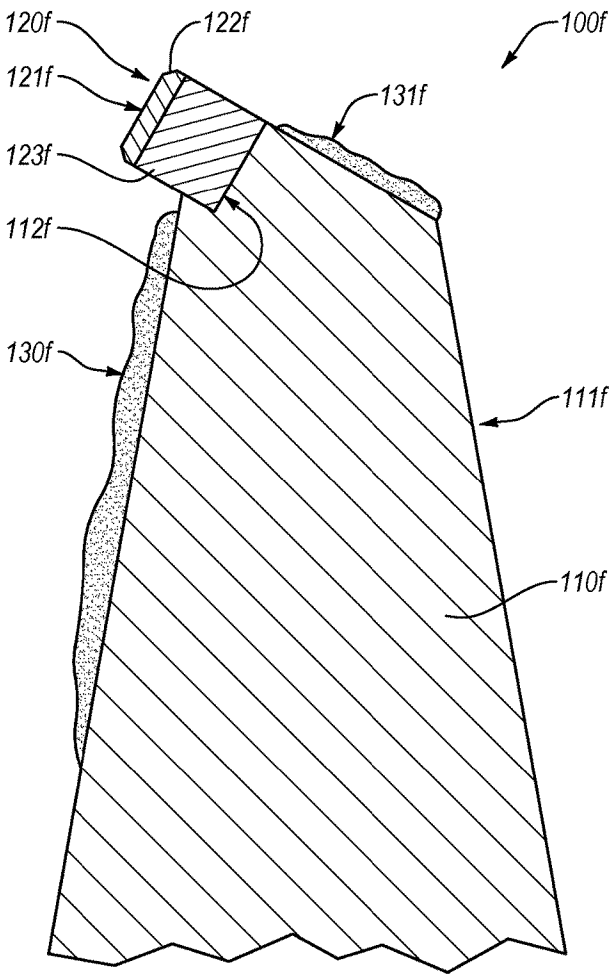
FIG. 4B is a partial cross-sectional view of a cutting tool assembly according to another embodiment of the invention.
Figure 4A:
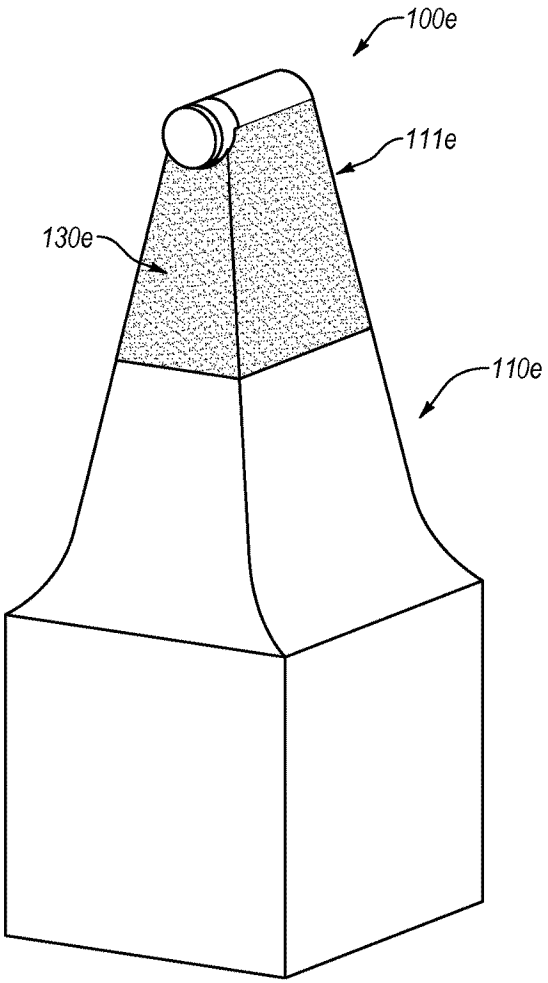
FIG. 4A is an isometric view of a cutting tool assembly according to an embodiment of the invention.

Conversely, embodiments also may include a shield that is permanently secured or attached to the support block. For example, FIG. 4A illustrates a cutting tool assembly 100*e* that includes a shield 130*e* permanently secured to a support block 110*e*. Except as otherwise described herein, the cutting tool assembly 100*e* and its materials, elements, or components may be similar to or the same as any of the cutting tool assemblies 100, 100*a*, 100*b*, 100*c*, 100*d* (FIGS. 1A-1B, 3A-3C) and their respective materials, elements and components.

In an embodiment, the shield 130*e* may include one or more of hardfacing, a coating, or plating that may at least partially surround the support block 110*e*. For example, the hardfacing may be a suitable wear resistant cobalt alloy (e.g., a cobalt-chromium alloy). As another example, the hardfacing may be a commercially available CVD tungsten carbide layer (currently marketed under the trademark HARDIDE®), which is currently available from Hardide Layers Inc. of Houston, Tex. For example, the tungsten carbide layer may be formed by physical vapor deposition ("PVD"), variants of PVD, high-velocity oxygen fuel ("HVOF") thermal spray processes, welding process, flame-spraying process, or any other suitable process, without limitation. The shield 130*e* may be located on at least a portion of at least one side of a working end 111*e* of the support block 110*e*. In at least one embodiment, the shield 130*e* may be located on portions of all of the sides of the working end 111*e*. In any event, the shield 130*e* may protect the underlying material of the support block 110*e* against wear and abrasion, thereby extending useful life thereof.

It should be appreciated that hardfacing or other coating may be included on any support block described herein, including support blocks that secure one or more other shields. FIG. 4B illustrates a cutting tool assembly 100*f* that includes a support block 110*f* with shields 130*f*, 131*f* protecting at least a portion of a working end 111*f* of the support block 110*f*. Except as otherwise described herein, the cutting tool assembly 100*f* and its materials, elements, or components may be similar to or the same as any of the cutting tool assemblies 100, 100*a*, 100*b*, 100*c*, 100*d*, 100*e* (FIGS. 1A-1B, 3A-3C, 4A) and their respective materials, elements and components. For example, the support block 110*f* may be similar to or the same as the support block 110*b* (FIG. 3A).

Moreover, in at least one embodiment, the hardfacing or coating may cover the uppermost portion or the top of the support block 110*f*, thereby forming the shields 130*f*, 131*f*. Also, similar to the cutting tool assembly 100*b* (FIG. 3A) the support block 110*f* may include a cutting element 120*f* secured to the support block 110*f*. As described above, in some examples, the cutting element 120*f* may include a chamfer 122*f* that at least partially circumscribes a superhard working surface 121*f*.

Furthermore, the cutting element 120*f* may be secured in a pocket or recess 112*f*. For example, the recess 112*f* may set the particular location and/or orientation of the cutting element 120*f* relative to the support block 110*f*. Also, in an embodiment, the shields 130*f*, 131*f* may at least partially surround and protect the recess 112*f*, thereby protecting the attachment of the cutting element 120*f* with the support block 110*f* during operation of the cutting tool assembly 100*f*. Moreover, one or more of the shields 130*f*, 131*f* may extend over or at least partially cover a substrate 123*f* of the cutting element 120*f*. Additionally or alternatively, the cutting tool assembly 100*f* may include one or more gaps between respective shields 130*f*, 131*f* and the cutting element 120*f* (e.g., between the respective shields 130*f*, 131*f* and the substrate 123*f* of the cutting element 120*f*).

Figure 4C:
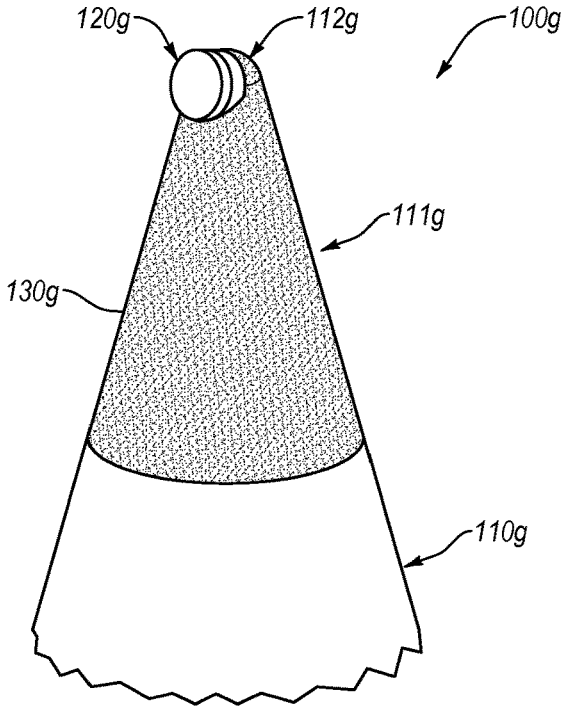
FIG. 4C is a partial isometric view of a cutting tool assembly according to yet another embodiment of the invention.

While in some embodiments the support block may have a pyramid like or trapezoidal shape, this disclosure is not so limited; the support block may have any number of suitable shapes. For example, FIG. 4C illustrates a cutting tool assembly 100*g* that includes a support block 110*g* a portion of which has an approximately conical shape. Except as otherwise described herein, the cutting tool assembly 100*g* and its materials, elements, or components may be similar to or the same as any of the cutting tool assemblies 100, 100*a*, 100*b*, 100*c*, 100*d*, 100*e*, 100*f* (FIGS. 1A-1B, 3A-3C, 4A-4B) and their respective materials, elements and components. In an embodiment, a working end 111*g* of the support block 110*g* may have an approximately conical shape. Moreover, the approximate cone of the working end 111*g* may include an approximately spherical apex or tip 112*g*.

In some embodiments, the cutting tool assembly 100*g* may include a shield 130*g* that may at least partially wrap around the working end 111*g*. For example, the shield 130*g* may include hardfacing, coating, and the like, which may be bonded or otherwise secured or integrated with the support block 110*g*. Moreover, the cutting tool assembly 100*g* may include a cutting element 120*g* secured to the support block 110*g*. In particular, in at least one embodiment, the shield 130*g* may surround a portion of the working end 111*g* of the support block 110*g* (e.g., the shield 130*g* may completely surround a portion of the support block 110*g* adjacent to or surrounding the cutting element 120*g*).

Figure 4D:
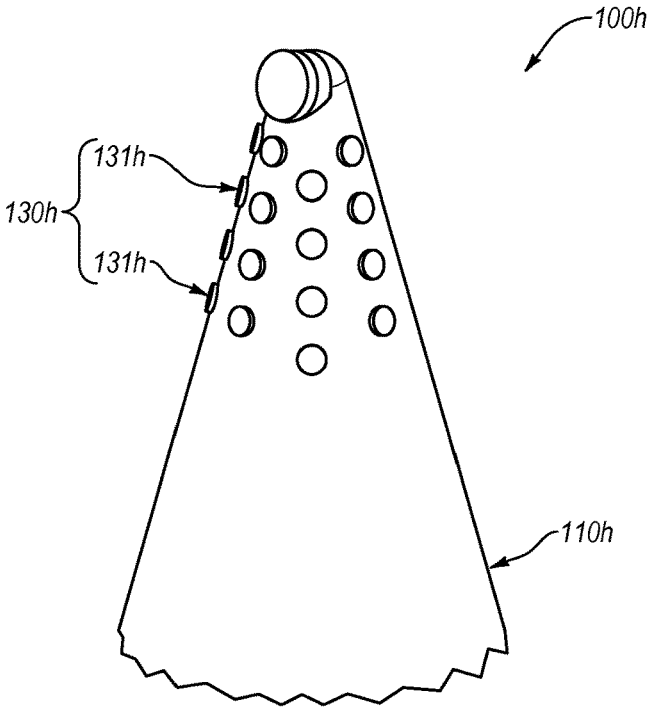
FIG. 4D is a partial isometric view of a cutting tool assembly according to still another embodiment of the invention.

In additional or alternative embodiments, the shield may include multiple elements or components secured to or integrated with the support block. FIG. 4D illustrates a cutting tool assembly 100*h* that includes multiple shield elements 131*h*, which together form a shield 130*h*. Except as otherwise described herein, the cutting tool assembly 100*h* and its materials, elements, or components may be similar to or the same as any of the cutting tool assemblies 100, 100*a*, 100*b*, 100*c*, 100*d*, 100*e*, 100*f*, 100*g* (FIGS. 1A-1B, 3A-3C, 4A-4C) and their respective materials, elements and components.

The shield elements 131*h* may be secured to the support block 110*h* in any number of suitable ways including, but not limited to, brazing, press fitting, fastening, etc. Moreover, the shield elements 131*h* may cover a portion of the support block, thereby providing protection to such portion from wear and abrasion during operation of the cutting tool assembly 100*h*. For example, the shield elements 131*h* may comprise any of the superhard elements disclosed herein. In another embodiment, shield elements may comprise cemented tungsten carbide. For instance, cobalt-cemented tungsten carbide, which may be domed, flat, or otherwise shaped.

Figure 5A:
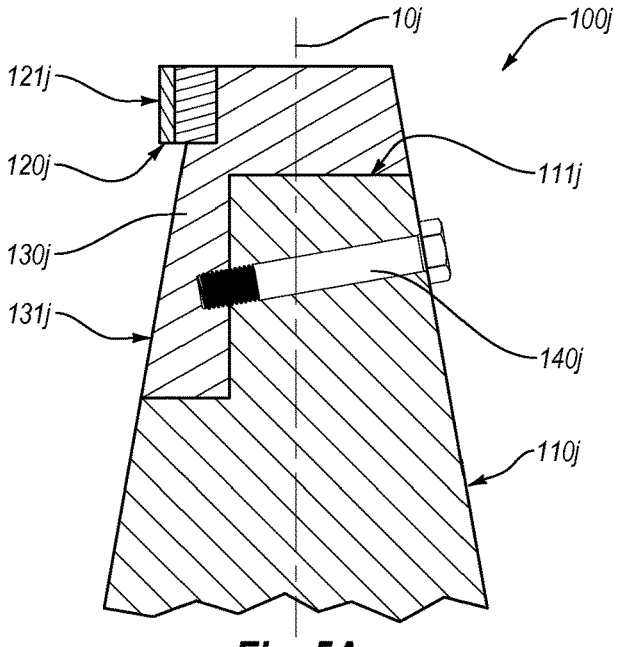
FIG. 5A is a partial cross-sectional view of a cutting tool assembly according to another embodiment of the invention.

In some embodiments, the cutting element may be secured to the shield or integrated therewith. Moreover, in some instances, both the shield and the cutting element secured thereto may be removable and/or replaceable, with may extend useful life of the cutting assembly (i.e., by replacing the shield and the cutting element). For example, FIG. 5A illustrates a cutting tool assembly 100*j* that includes cutting element 120*j* secured to a shield 130*j*. Except as otherwise described herein, the cutting tool assembly 100*j* and its materials, elements, or components may be similar to or the same as any of the cutting tool assemblies 100, 100*a*, 100*b*, 100*c*, 100*d*, 100*e*, 100*f*, 100*g*, 100*h* (FIGS. 1A-1B, 3A-3C, 4A-4D) and their respective materials, elements and components. For example, a support block 110*j* may be similar to or the same as the support block 110*b* (FIG. 3A). In an embodiment, the shield 130*j* may be fastened to a support block 110*j* with one or more threaded fastener 140*j*.

In some embodiments, the cutting element 120*j* may be brazed or otherwise secured to the shield 130*j*. Consequently, the threaded fastener 140*j* may secure both the shield 130*j* and the cutting element 120*j* by fastening the shield 130*j* to the support block 110*j*. As described above, the shield 130*j* may include a shielding face 131*j* that may shield a front face of the cutting tool assembly 100*j*. Furthermore, in some instances, the shield 130*j* also may form a top portion of the cutting tool assembly 100*j*. For example, the support block 110*j* may be truncated along a surface 111*j*, and the shield 130*j* may extend from the surface 111*j* upward, to form the top portion as well as the top of the cutting tool assembly 100*j*.

At least one embodiment, the cutting element 120*j* may include a superhard working surface 121*j* that may have an approximately parallel orientation relative to a longitudinal centerline 10*j*. As such, orienting the cutting tool assembly 100*j* on a rotary drum assembly (see FIGS. 10A and 10B) in a manner that longitudinal centerline 10*j* aligns a radius centered on the center or rotation of the rotary drum assembly may orient the superhard working surface 121*j* in a manner that the superhard working surface 121*j* has no rake angle. As noted above, however, the cutting tool assembly 100*j* may have any suitable orientation on the rotary drum assembly, and the superhard working surface 121*j* may have a negative or positive rake angle when the cutting tool assembly 100*j* is secured to the rotary drum assembly.

Figure 5B:
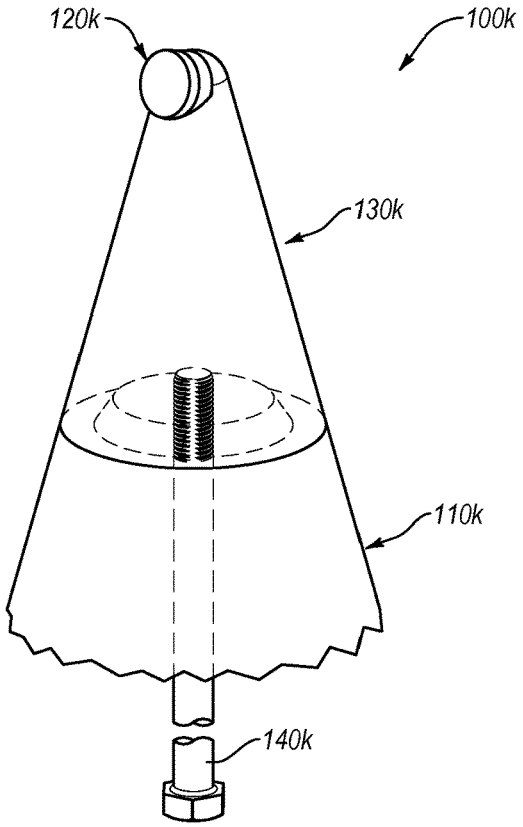
FIG. 5B is a partial isometric view of a cutting tool assembly according to still yet one other embodiment of the invention.
Figure 5C:
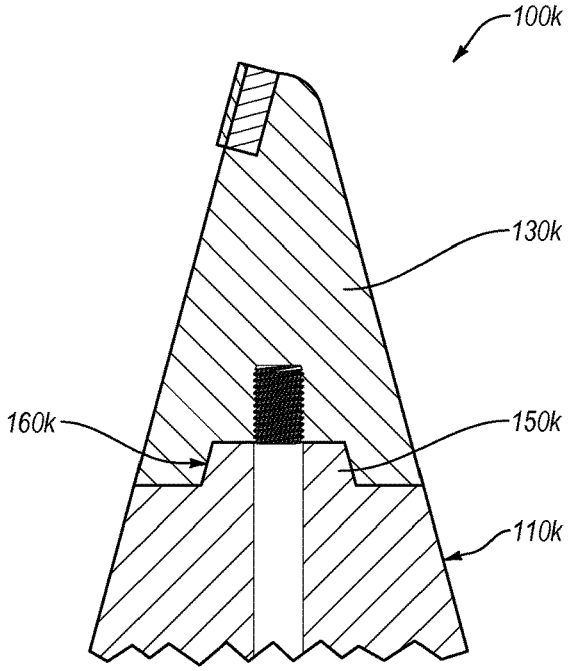
FIG. 5C is a partial cross-sectional view of the cutting tool assembly of FIG. 5B.

It should be appreciated that the shield and the cutting element combination may be secured to the support block in any number of suitable ways. For example, FIGS. 5B and 5C illustrate a cutting tool assembly 100*k* that includes an approximately conical shield 130*k* and cutting element 120*k* secured to or incorporated with the shield 130*k*. Except as otherwise described herein, the cutting tool assembly 100*k* and its materials, elements, or components may be similar to or the same as any of the cutting tool assemblies 100, 100*a*, 100*b*, 100*c*, 100*d*, 100*e*, 100*f*, 100*g*, 100*h*, 100*j* (FIGS. 1A-1B, 3A-3C, 4A-4D, 5A) and their respective materials, elements and components. For example, the shape of the cutting tool assembly 100*k* may be similar to or the same as the shape of the cutting tool assembly 100*g* (FIG. 4C). Moreover, as described below in further detail, it should be appreciated that the shield may have any suitable shape and/or size.

As shown in FIG. 5B, the combined shield 130*k* and cutting element 120*k* may be secured to a support block 110*k*. For example, the cutting tool assembly 100*k* may include a threaded fastener 140*k* that may fasten the shield 130*k* to the support block 110*k*. Moreover, the shield 130*k* may form a working end of the cutting tool assembly 100*k*. Furthermore, as shown in FIG. 5C, the support block 110*k* and the shield 130*k* may include corresponding locating features that may locate the shield 130*k* relative to the support block 110*k* (e.g., concentrically with each other). For example, the locating feature of the support block 110*k* may include a tapered protrusion 150*k*, which may have the shape of a truncated cone, and which may be positioned within a corresponding recess 160*k* in the shield 130*k*. More specifically, the tapered protrusion 150*k* and the recess 160*k* may have the same, similar, or different taper angles, such as to align the shield 130*k* relative to the support block 110*k*.

It should also be appreciated that the cutting tool assembly 100*k* may include any suitable alignment feature, which may locate or orient the shield 130*k* relative to the support block 110*k*. For example, the shield may include a protrusion, while the support block may include a corresponding recess. Furthermore, the shield 130*k* and the support block 110 may include one or more recesses that may engage or accept one or more dowels.

Figure 5D:
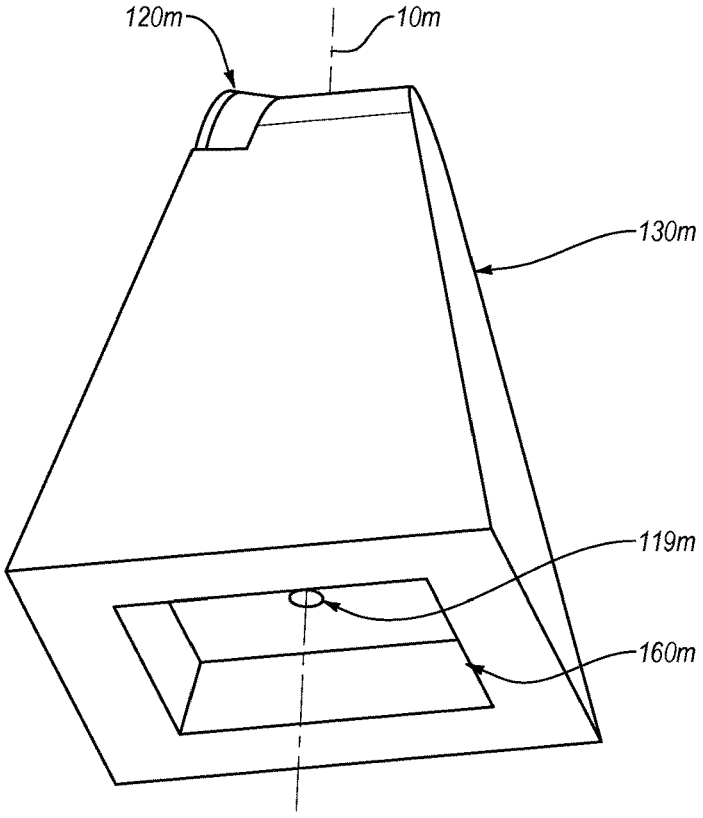
FIG. 5D is an isometric view of a shield with an attached cutting element according to an embodiment of the invention.

Alignment features may have any suitable shape and/or size. For example, FIG. 5D illustrates another example of a suitable alignment feature included in a shield 130*m*. Except as otherwise described herein, the shield 130*m* and its materials, elements, or components may be similar to or the same as any of the shields 130, 130*a*, 130*b*, 130*c*, 130*d*, 130*e*, 130*f*, 130*g*, 130*h*, 130*j*, 130*k* (FIGS. 1A-1B and 3A-5C) and their respective materials, elements and components. In an embodiment, a cutting element 120*m* may be secured to the shield 130*m*. Furthermore, the shield 130*m* may include a recess 160*m* that may accept a corresponding protrusion of a support block. More specifically, the recess 160*m* may accept a pyramid-shaped protrusion, which may align and/or orient the shield 130*m* relative to the support block. It should be appreciated that the multi-sided shapes of the recess 160*m* and the corresponding protrusion of the support block may facilitate axial orientation of the shield 130*m* relative to the support block about a longitudinal centerline 10*m*.

As noted above, the shield may have any suitable shape and/or size. In some instances, as shown in FIG. 5D, the shield 130*m* may have a pyramid-like shape. Furthermore, in some embodiments, the pyramid-like shield may include radii or fillets or chamfers extending between adjacent sides thereof. Also, embodiments may include a shield that has an approximately rectangular or cylindrical shape or other suitable shapes.

Figure 5E:
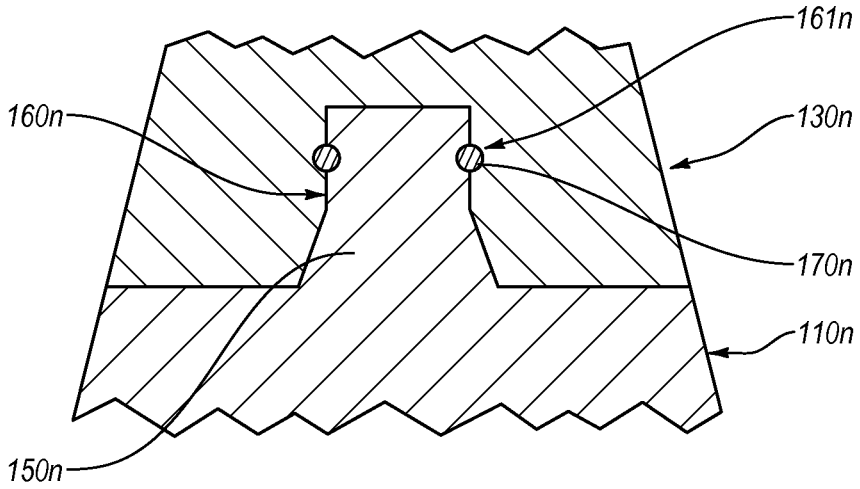
FIG. 5E is a partial cross-sectional view of a shield attached to a support block according to an embodiment of the invention.

In some embodiments, the alignment feature also may include an attachment mechanism, which may facilitate attachment of the shield to the support block. In one example, the shield 130*m* may include a threaded hole 119*m* that may accept and be secured by a threaded fastener. Additionally or alternatively, as shown in FIG. 5E a shield 130*n* may include a recess 160*n* that has a channel 161*n* that may facilitate securing the shield 130*n* to a support block 110*n*. Except as otherwise described herein, the shield 130*n* and its materials, elements, or components may be similar to or the same as any of the shields 130, 130*a*, 130*b*, 130*c*, 130*d*, 130*e*, 130*f*, 130*g*, 130*h*, 130*j*, 130*k*, 130*m* (FIGS. 1A-1B and 3A-5D) and their respective materials, elements and components. For example, at least a portion of the recess 160*n* may have tapered walls, similar to or the same as any of the shields 130*k*, 130*m* (FIGS. 5C-5D).

In an embodiment, the support block 110*n* may include a protrusion 150*n* that may be shaped and sized to correspond with the shape and size of the recess 160*n*. In some instances, the recess 160*n* and the protrusion 150*n* may include a straight or non-tapered portion that may facilitate attachment of the shield 130*n* to the support block 110*n*. For example, the straight portion of the protrusion 150*n* may include one or more features that may enter and/or may be secured within the channel 161*n*.

In an embodiment, an expandable or deformable element (e.g., a semispherical, a hemispherical, or a ring-like element) may be positioned within or engage the channel 161*n*. For example, an expandable element 170*n*, such as a split ring, a snap ring, or circlip may be placed or positioned about the protrusion 150*n*. The expandable element 170*n* may include resilient material and may be compressible about the protrusion 150*n*. As such, the expandable element 170*n* may be compressed as the protrusion 150*n* enters the recess 160*n* and may at least partially expand toward the uncompressed state after entering the channel 161*n*. When positioned within the channel 161*n*, the expandable element 170*n* may secure the shield 130*n* to the support block 110*n*.

Figure 5F:
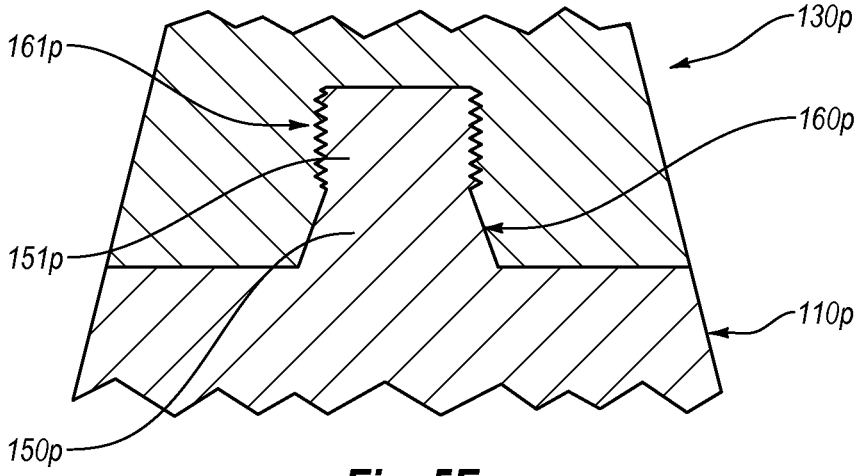
FIG. 5F is a partial cross-sectional view of a shield attached to a support block according to another embodiment of the invention.

As shown in FIG. 5F, in one or more embodiments, a shield 130*p* may include a threaded portion that may be threaded to a corresponding portion of a support block 110*p*, thereby securing together the shield 130*p* and the support block 110*p*. Except as otherwise described herein, the shield 130*p* and its materials, elements, or components may be similar to or the same as any of the shields 130, 130*a*, 130*b*, 130*c*, 130*d*, 130*e*, 130*f*, 130*g*, 130*h*, 130*j*, 130*k*, 130*m*, 130*n* (FIGS. 1A-1B, 3A-5E) and their respective materials, elements and components. For example, the shield 130*p* may include a recess 160*p* that may be similar to the recess 160*n* (FIG. 5E).

In at least one embodiment, the recess 160*p* may include a threaded portion 161*p* that may accept a threaded member that may secure the shield 130*p* to the support block 110*p*. For example, the support block 110*p* may include a protrusion 150*p* that may have a corresponding shape and size with the recess 160*p*. In particular, in an embodiment, the protrusion 150*p* may include a threaded portion 151*p* that may be threaded into the threaded portion 161*p* to secure the shield 130*p* to the support block 110*p*. It should be appreciated that the corresponding tapered portions of the recess 160*p* and protrusion 150*p* may align the shield 130*p* relative to the support block 110*p*.

In some instances, a securing mechanism may be included to prevent unscrewing the shield 130*p* from the support block 110*p* during operation. For example, a compressible or lock washer may be placed between the shield 130*p* and support block 110*p*. Additionally or alternatively, a thread-locking substance (e.g., LOCTITE® THREADLOCKER) may be placed between the threaded portion 161*p* and the threaded portion 151*p*. In any event, the threaded portions 151*p*, 161*p* may securely attach the shield 130*p* to the support block 110*p*, such that the shield 130*p* may remain attached together during operation of the cutting tool assembly.

Figure 6A:
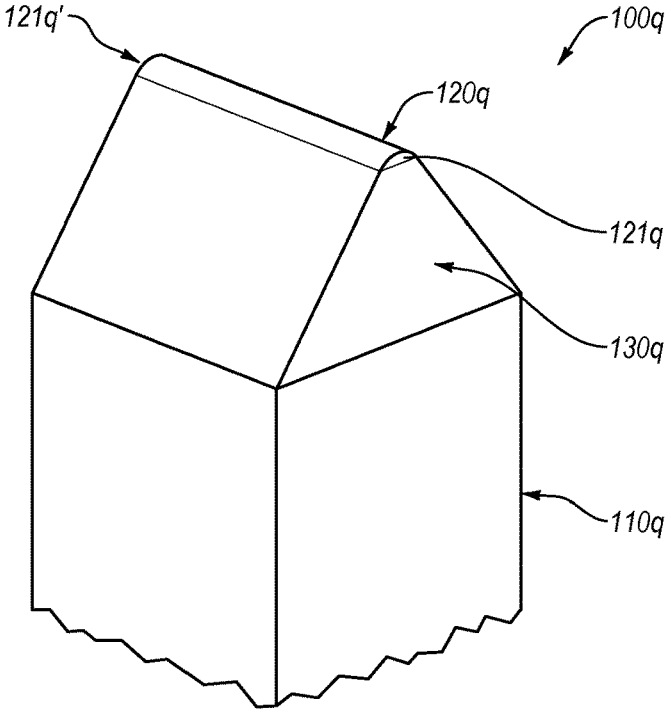
FIG. 6A is a partial isometric view of a cutting tool assembly according to an embodiment of the invention.

As described above, cutting tool assemblies may include multiple cutting elements or multi-faced cutting elements, which in some instances may facilitate indexing the cutting tool assemblies in a manner that extends the useful life thereof. FIG. 6A illustrates a cutting tool assembly 100*q* that may include a cutting element 120*q* secured to a support block 110*q*. Except as otherwise described herein, the cutting tool assembly 100*q* and its materials, elements, or components may be similar to or the same as any of the cutting tool assemblies 100, 100*a*, 100*b*, 100*c*, 100*d*, 100*e*, 100*f*, 100*g*, 100*h*, 100*j*, 100*k* (FIGS. 1A-1B, 3A-3C, and 4A-5C) and their respective materials, elements and components. For example, the shape of the cutting tool assembly 100*q* may be similar to or the same as the shape of the cutting tool assembly 100*d* (FIG. 3C).

In an embodiment, the cutting element 120*q* may be a generally convex-shaped strip of superhard material that includes superhard working surfaces 121*q*, 121*q*'. More specifically, the superhard working surface 121*q* may face in a first direction, while the superhard working surface 121*q*' may face in a second, different direction. In some embodiment, the second direction may be opposite to the first direction. In one embodiment, the cutting tool assembly 100*q* and the superhard working surface 121*q* may be positioned and/or oriented in a manner that facilitates engagement of the superhard working surface 121*q* with the target material during operation of the cutting tool assembly 100*q*. As the superhard working surface 121*q* wears beyond a usable or suitable state, however, the cutting tool assembly 100*q* or a portion thereof may be reoriented, repositioned, or indexed in a manner that allows the superhard working surface 121*q*' to engage the target material during the operation of the cutting tool assembly 100*q*.

For example, the cutting tool assembly 100*q* may be rotated 180° (e.g., about a center axis thereof) to index the superhard working surface 121*q*' into a cutting position. It should be appreciated that a particular location and orientation of the superhard working surface 121*q* and of the superhard working surface 121*q*' may vary from one embodiment to the next. In some instances, the superhard working surfaces may be positioned at about a 90° angles relative to one another or at any other suitable angle that may facilitate indexing of the cutting tool assembly 100*q* to place one or more of the working services into cutting position. In any event, in some embodiments, during the operation of the cutting tool assembly, as one or more of the working surfaces and/or of the cutting elements wears beyond a useful state, the cutting tool assembly may be rotated or indexed to place another superhard working surface into the cutting position.

In some embodiments, the cutting tool assembly 100*q* may include a shield 130*q*, which may be similar to or the same as any shield described herein. In some embodiments, the shield 130*q* may have a shape of a truncated, two-sided pyramid. The cutting element 120*q* may be attached to the shield 130*q*, which may secure the cutting element 120*q* to the support block 110*q*. In one example, the shield 130*q* also may be secured to the support block 110*q*. Alternatively, however, the shield 130*q* may be removably and/or replicable secured to the support block 110*q*. As such, the shield 130*q* may be loosened and/or detached from the support block 110*q* and indexed to place any of the superhard working surfaces 121*q*, 121*q*' into the cutting position.

Figure 6B:
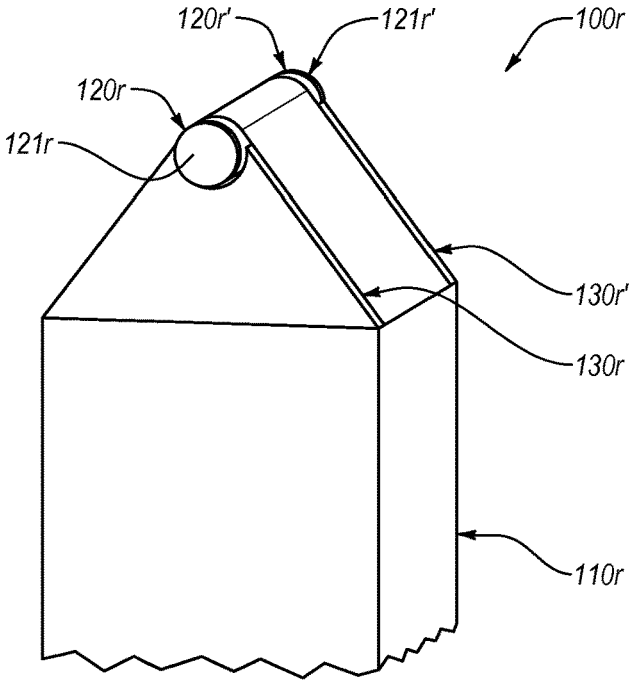
FIG. 6B is a partial isometric view of a cutting tool assembly according to another embodiment of the invention.

In additional or alternative embodiments, as shown in FIG. 6B, a cutting tool assembly 100*r* may include multiple cutting elements, such as cutting element 120*r* and cutting element 120*f*, each of which may include one or more superhard working surfaces that may be indexed or selectively positioned into a cutting position. Except as otherwise described herein, the cutting tool assembly 100*r* and its materials, elements, or components may be similar to or the same as any of the cutting tool assemblies 100, 100*a*, 100*b*, 100*c*, 100*d*, 100*e*, 100*f*, 100*g*, 100*h*, 100*j*, 100*k*, 100*q* (FIGS. 1A-1B, 3A-3C, 4A-5C, and 6A) and their respective materials, elements and components. For example, the cutting tool assembly 100*r* may have a similar shape and/or size as the cutting tool assembly 100*q* (FIG. 6A).

In some embodiments, the cutting elements 120*r*, 120*r*' may be secured to a support block 110*r*. Moreover, the cutting elements 120*r*, 120*r*' may include corresponding superhard working surfaces 121*r*, 121*r*'. In one example, the superhard working surface 121*r* may face in opposing directions from the superhard working surface 121*r*'. Alternatively, however, the superhard working surface 121*r* and the superhard working surface 121*r*' may be oriented relative to each other in any suitable manner that allows indexing or selective positioning thereof, as described above.

In an embodiment, the cutting tool assembly 100*r* may include multiple shields, such as shields 130*r*, 130*f*. More specifically, the shield 130*r* may protect the support block 110*r* and the cutting element 120*r* when the cutting tool assembly 100*r* is indexed or positioned in a manner that places the cutting element 120*r* into the working or cutting position. Similarly, the shield 130*r*' may protect the support block 110*r* and the cutting element 120*r*' when the cutting tool assembly 100*r* is indexed or positioned in a manner that places the cutting element 120*r*' into the working or cutting position.

Figure 7:
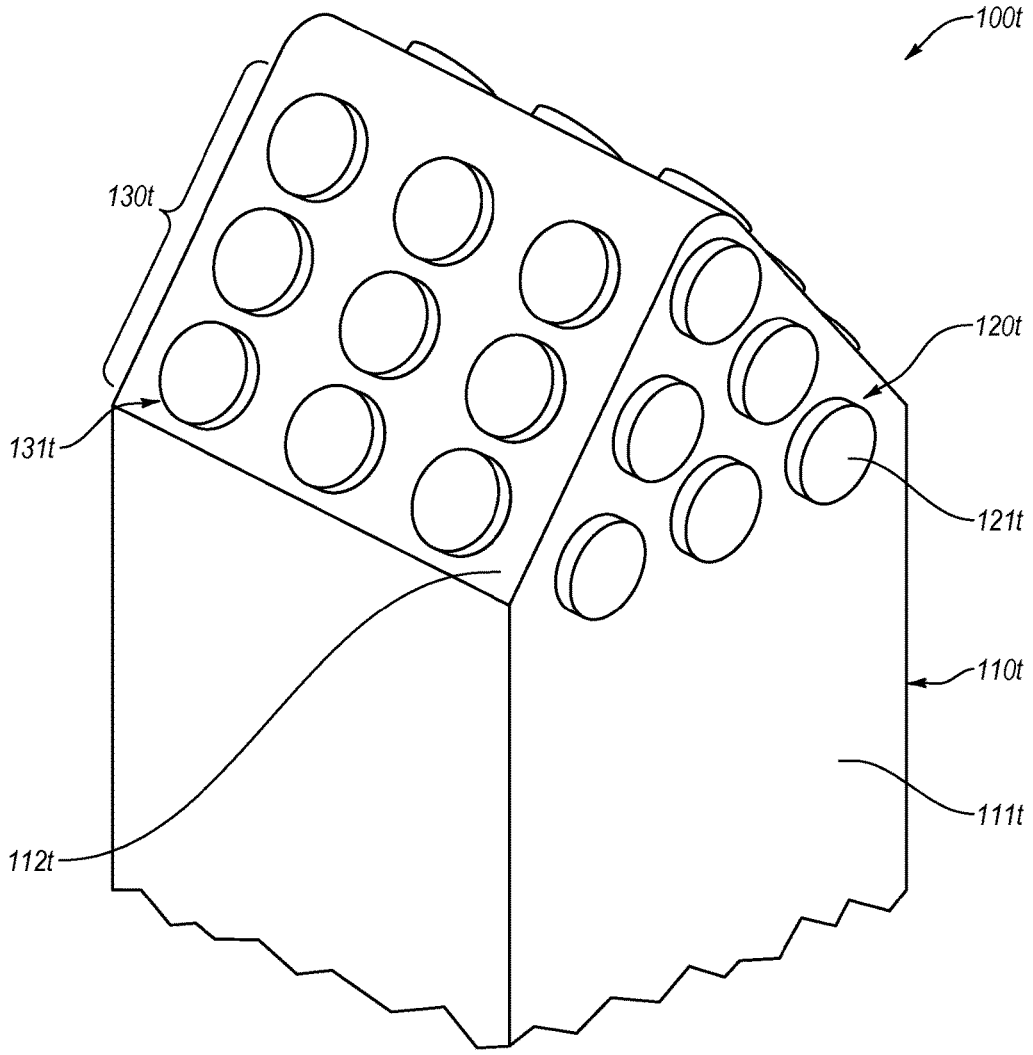
FIG. 7 is a partial isometric view of a cutting tool assembly according to yet another embodiment of the invention.

As mentioned above, the cutting tool assembly may include any suitable number of cutting elements as well as shield elements. As shown in FIG. 7, a cutting tool assembly 100*t* may include multiple cutting elements 120*t* secured to a support block 110*t*. Except as otherwise described herein, the cutting tool assembly 100*t* and its materials, elements, or components may be similar to or the same as any of the cutting tool assemblies 100, 100*a*, 100*b*, 100*c*, 100*d*, 100*e*, 100*f*, 100*g*, 100*h*, 100*j*, 100*k*, 100*q*, 100*r* (FIGS. 1A-1B, 3A-3C, 4A-5C, and 6A-6B) and their respective materials, elements and components. For example, the cutting tool assembly 100*t* may have a similar shape and/or size as the cutting tool assembly 100*q* (FIG. 6A).

In at least one embodiment, the cutting elements 120*t* may include corresponding superhard working surfaces 121*t* that may face approximately in the same direction. For example, the superhard working surfaces 121*t* may be approximately planar. Moreover, the superhard working surfaces 121*t* may lie an approximately the same plane with one another (e.g., in a flat plane).

The superhard working surfaces 121*t* may be arranged on the support block 110*t* in any number of suitable configurations. In some embodiments, the superhard working surfaces 121*t* may be arranged in multiple rows. Furthermore, each of the rows may include different number of the superhard working surfaces 121*t*. In an embodiment, the superhard working surfaces 121*t* may be arranged in a manner that follows at least a portion of the outer contour of a front face 111*t* of the support block 110*t*.

As described above, in an embodiment, the cutting tool assembly 100*t* may include multiple shield elements 131*t* (e.g., any superhard element disclosed herein) that collectively may form a shield 130*t*. For instance, one or more shield elements 131*t* may be polycrystalline diamond. Additionally or alternatively, one or more shield elements 131*t* may be cemented tungsten carbide (e.g., cobalt cemented tungsten carbide). The shield elements 131*t* also may be arranged in multiple rows and may generally fill one or more surfaces of the support block 110*t*, in a manner that protects such surfaces. For example, the shield elements 131*t* may be positioned on a slanted surface 112*t* of the support block 110*t*, thereby protecting the slanted surface 112*t*.

As mentioned above, in some embodiments, the cutting tool assembly may be shaped in a manner that reduces or minimizes wear of the support block during the operation of the cutting tool assembly. As described below in further detail, the cutting tool assemblies may be secured to a rotary drum assembly. Moreover, as the rotary drum assembly moves the cutting tool assemblies through the target material and fails such target material, the failed material may be passed through the rotary drum assembly and may abrade the cutting tool assemblies. In some instances, cutting tool assemblies located on the left side of the rotary drum assembly may be abraded on the right side thereof and vice versa.

Figure 8B:
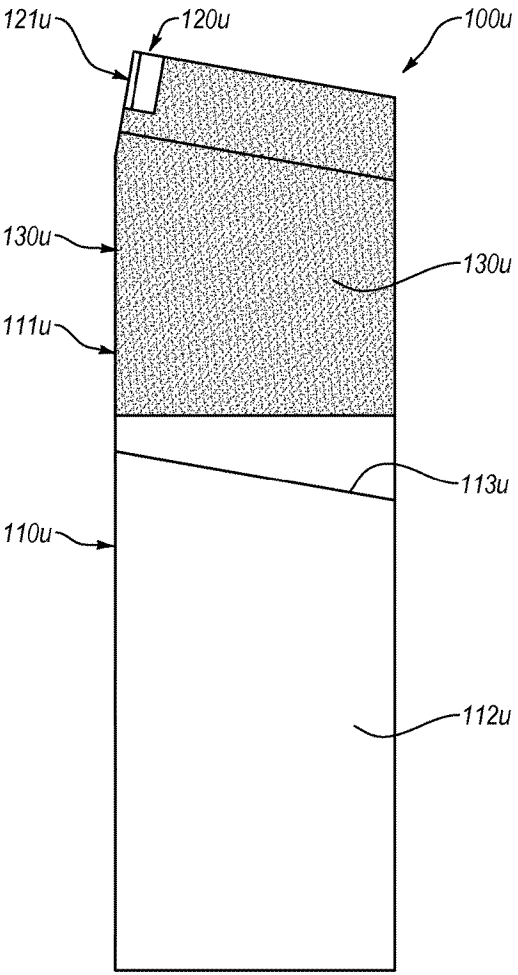
FIG. 8B is a side view of the cutting tool assembly of FIG. 8A.
Figure 8A:
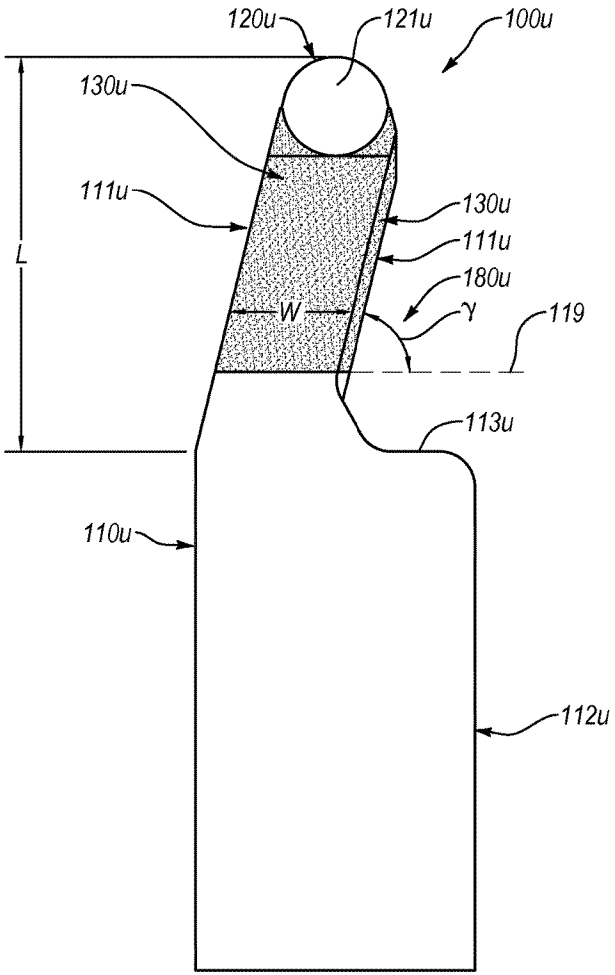
FIG. 8A is a front view of a cutting tool assembly according to an embodiment of the invention.

FIGS. 8A and 8B illustrate a cutting tool assembly 100*u* that includes a support block 110*u* with working end 111*u* and a mounting end 112*u*. Except as otherwise described herein, the cutting tool assembly 100*u* and its materials, elements, or components may be similar to or the same as any of the cutting tool assemblies 100, 100*a*, 100*b*, 100*c*, 100*d*, 100*e*, 100*f*, 100*g*, 100*h*, 100*j*, 100*k*, 100*q*, 100*r* (FIGS. 1A-1B, 3A-3C, 4A-5C, and 6A-7) and their respective materials, elements and components. As shown in FIG. 8A, in an embodiment, a cutting element 120*u* may be secured to the working end 111*u* of the support block 110*u*.

Additionally, the support block 110*u* may include a carve-out 180*u* that may allow the failed target material to pass by the support block 110*u* without contacting or with reduced contact with the support block 110*u*. For example, the cutting tool assembly 100*u* may be secured on a left side of the rotary drum assembly and may include a carve-out 180*u* on a right side of the support block 110*u* (as viewed from the side of a superhard working surface 121*u*). The carve-out 180*u* may form the working end 111*u* of the support block 110*u*. Particularly, in an embodiment, the working end 111*u* may have a smaller width than the mounting end 112*u* of the support block 110*u*. Furthermore, in some embodiments, a side of the working end 111*u* may be oriented at a non-orthogonal angle relative to a top face 113*u* of the mounting end 112*u*. For example, the side of working end 111*u* may form an acute angle γ with an imaginary reference line 119.

In some embodiments, the working end 111*u* may have a length L and width W. For example, the length L may be greater than the width W by a factor (i.e., L=factor×W) in one or more of the following ranges: between about 1.2 and 1.5; between about 1.4 and 2; between about 1.6 and 3; and between about 2.5 and 5. It should be also appreciated that the factor correlating length L to width W may be less than 1.2 or greater than 5. Thus, as shown in FIGS. 8A-8F, the working end 111*u* constitutes an elongated region of the cutting tool assembly 100*u* that extends from the mounting end 112*u* and the width W of the working end 111*u*/elongated region is reduced/less relative to a width of the mounting end 112*u*.

In any event, however, the carve-out 180*u* may allow the failed material to pass by the support block 110*u* in a manner that may reduce or minimize contact of the failed material with the support block 110*u*. Furthermore, as shown in FIGS. 8A and 8B, in some embodiments, the cutting tool assembly 100*u* may include a shield 130*u*. For example, the shield 130*u* may include hardfacing, protective coating, and the like.

Figure 8D:
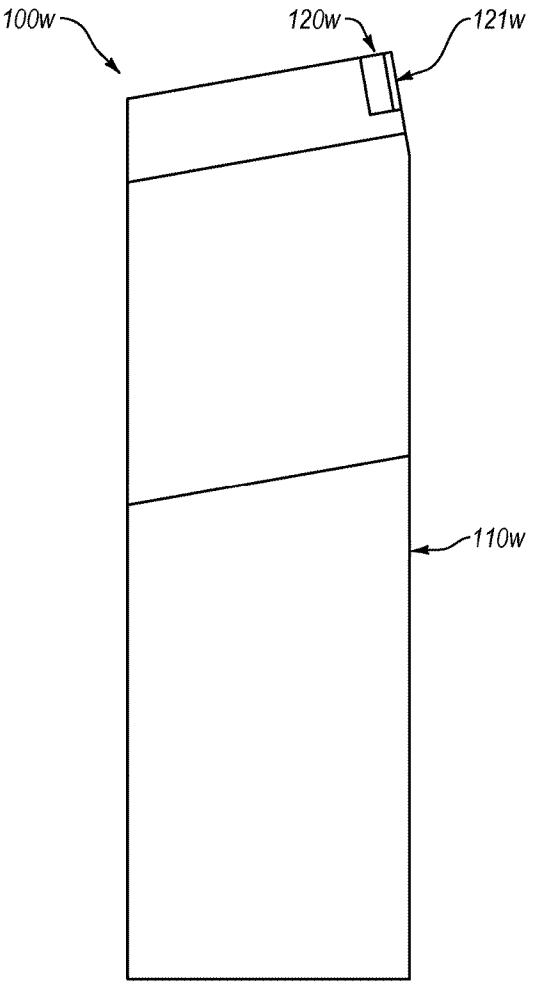
FIG. 8D is a side view of the cutting tool assembly of FIG. 8C.
Figure 8C:
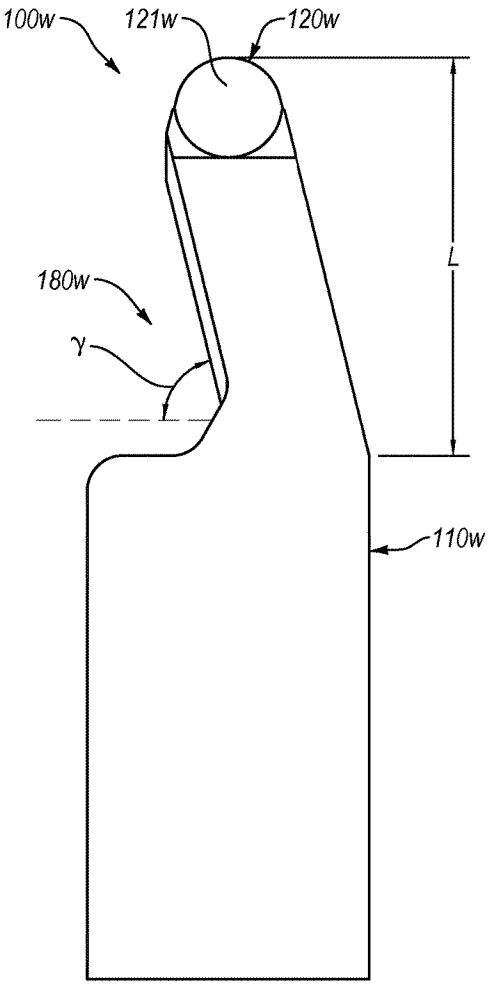
FIG. 8C is a front view of a cutting tool assembly according to another embodiment of the invention.

As described above, the wear of the cutting tool assemblies mounted on the rotary drum assembly may vary from one embodiment to the next. In some instances, the cutting tool assemblies mounted on the right side of the rotary drum assembly (as viewed from the front-facing side of the rotary drum assembly) may wear on the left side of the cutting tool assemblies. FIGS. 8C and 8D illustrates a cutting tool assembly 100*w* that may be secured on the right side of the rotary drum assembly. Except as otherwise described herein, the cutting tool assembly 100*w* and its materials, elements, or components may be similar to or the same as any of the cutting tool assemblies 100, 100*a*, 100*b*, 100*c*, 100*d*, 100*e*, 100*f*, 100*g*, 100*h*, 100*j*, 100*k*, 100*q*, 100*r*, 100*u* (FIGS. 1A-1B, 3A-3C, 4A-5C, and 6A-8B) and their respective materials, elements and components. For example, the cutting tool assembly 100*w* may be the same as the cutting tool assembly 100*u* (FIGS. 8A and 8B), but may be a mirrored image thereof. Particularly, the cutting tool assembly 100*w* may include a support block 110*w* that has a carve-out 180*w* on a left side thereof. Further, optionally, cutting tool assembly 100*w* may include a shield, which may be configured according to any of the embodiments disclosed herein, or combinations thereof.

In an embodiment, the support block 110*w* may have a working end that has a length L that may be similar to or the same as length L of the support block 110*u* (FIGS. 8A-8B). Also, in at least one embodiment, the working end of the support block 110*w* may form an angle γ with the remaining portion of the support block 110*w*. In some instances, the angle γ formed between the working end and the remaining portion of the support block 110*w* may be similar to or the same as the angle γ formed between the working end 111*u* and the remaining portion of the support block 110*u* (FIGS. 8A-8B).

Figure 8F:
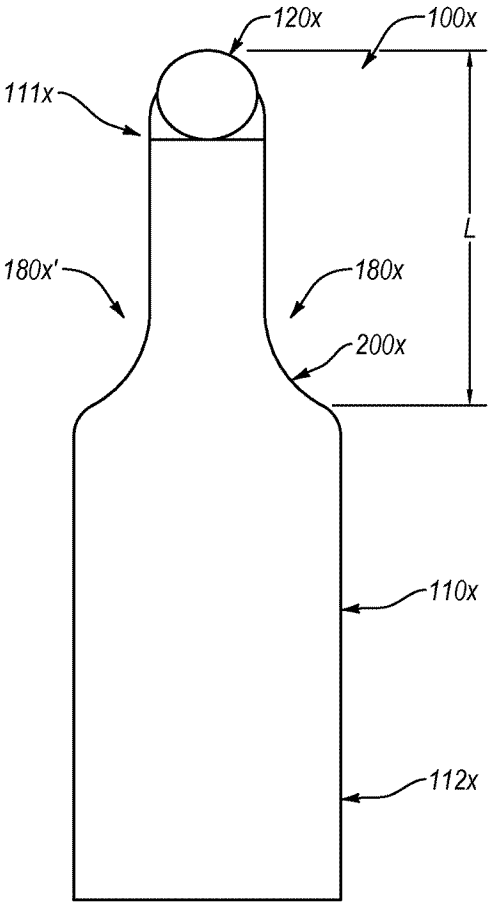
FIG. 8F is a front view of the cutting tool assembly of FIG. 8E.
Figure 8E:
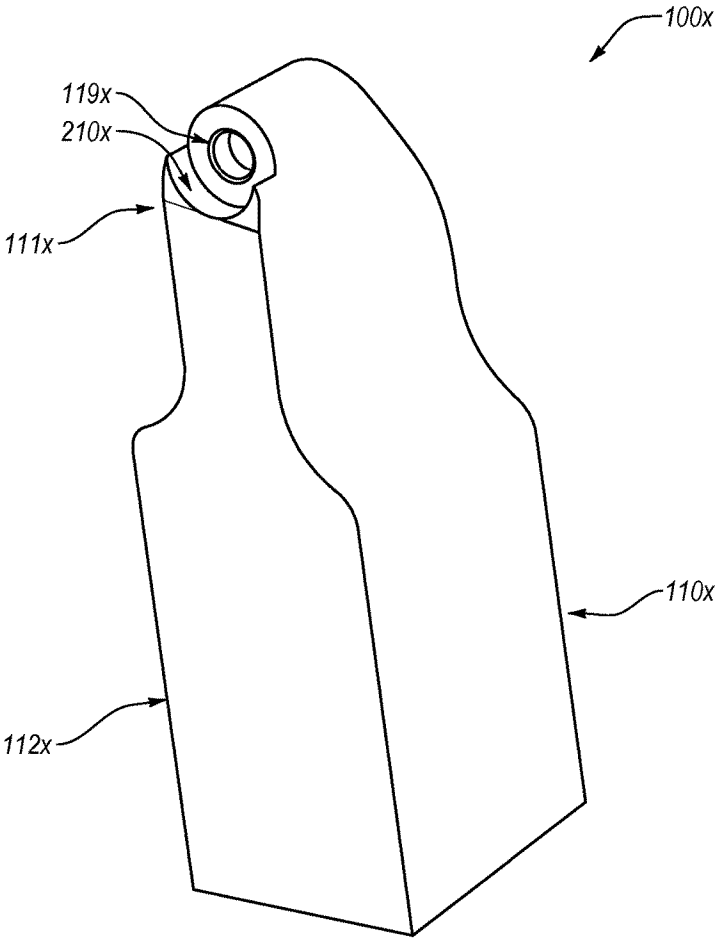
FIG. 8E is an isometric view of a cutting tool assembly according to an embodiment of the invention.

In some embodiment, the cutting tool assembly may include multiple carve-outs. For example, multiple carve-outs in the support block of the cutting tool assembly may facilitate interchangeability of the cutting tool assembly, such that the cutting tool assembly may be secured to either the left or the right side of the rotary drum assembly. FIGS. 8E and 8F illustrate a cutting tool assembly 100*x* that may have a support block 110*x* that includes opposing carve-outs 180*x*, 180*x*'. Except as otherwise described herein, the cutting tool assembly 100*x* and its materials, elements, or components may be similar to or the same as any of the cutting tool assemblies 100, 100*a*, 100*b*, 100*c*, 100*d*, 100*e*, 100*f*, 100*g*, 100*h*, 100*j*, 100*k*, 100*q*, 100*r*, 100*u*, 100*w* (FIGS. 1A-1B, 3A-3C, 4A-5C, and 6A-8E) and their respective materials, elements and components. For example, the cutting tool assembly 100*x* may include a cutting element 120*x* that may be similar to or the same as the cutting element 120*u* (FIGS. 8A-8B). Further, optionally, cutting tool assembly 100*x* may include a shield, which may be configured according to any of the embodiments disclosed herein, or combinations thereof.

In some embodiments, the carve-outs 180*x*, 180*x*' may form a working end 111*x* of the support block 110*x* that is thinner than a mounting end 112*x* of the support block 110*x*. Particular, the carve-outs 180*x*, 180*x*' may form the working end 111*x* that extends above the mounting end 112*x* of the support block 110*x* (e.g., extends by a length L, which may be similar to or the same as length L of the working end 111*u* of the support block 110*u* (FIGS. 8A-8B). In some instances, the support block 110*x* may include one or more radii 200*x* that may extend between at least a portion of the peripheral surface of the working end 111*x* and the mounting end 112*x*. In any event, however, the carve-outs 180*x*, 180*x*' may allow material failed and moved by the rotary drum assembly to pass by the support block 110*x* with reduced abrasion (as compared with a cutting tool assembly having a support block that does not include such carve-outs).

In some embodiments, as shown in FIG. 8E, the working end 111*x* of the support block 110*x* may include a seat 210*x* that may locate the cutting element 120*x* (FIG. 8F) relative to the working end 111*x* and to the support block 110*x*. In one example, the cutting element 120*x* (FIG. 8F) may have a circular cross-section. Accordingly, the seat 210*x* may have at least partially cylindrical or circular shape that may match the cylindrical peripheral surface of the cutting element 120*x* (FIG. 8F).

As mentioned above, in some instances, the cutting element may be removable and/or replaceable. Moreover, some cutting tool assemblies may include a fastener that may secure the cutting elements to the support block. For example, the cutting element 120*x* (FIG. 8F) may be secured to the support block 110*x* with a fastener (not shown) that may pass through an opening 119*x* and may threadedly engage the cutting element 120*x*, thereby securing the cutting element 120*x* to the support block 110*x*.

In some examples, the cutting element 120*x* (FIG. 8F) may be removed and/or replaced. For instance, the fastener that may secure the cutting element 120*x* (FIG. 8F) to the support block 110*x* may be unfastened from the cutting element 120*x* (FIG. 8F), thereby providing for removal of the cutting element 120*x* (FIG. 8F) from the support block 110*x*. Furthermore, in at least one embodiment, the cutting element 120*x* (FIG. 8F) and the seat 210*x* may be configured to allow indexing of the cutting element 120*x* (FIG. 8F).

For example, the cutting element 120*x* (FIG. 8F) may be rotated (e.g., about a center axis thereof) to expose unused or unworn portions thereof to target material. It should be appreciated that cutting elements may have any number of suitable shapes. Hence, for instance, a square, triangular, cylindrical, or polygonal cutting element may be rotated or indexed in a manner that exposes one or more unworn sides of the cutting element to the target material. Additionally or alternatively, the cutting elements (e.g., the cutting element 120*x* (FIG. 8F)) may be indexed in a manner that places an inward facing side thereof (i.e., the side facing the seat 210*x*) outward, toward the target material.

Figure 9B:
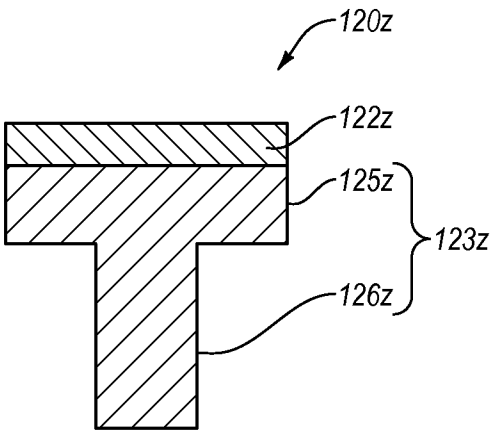
FIG. 9B is a cross-sectional view of a cutting element according to another embodiment of the invention.
Figure 9A:
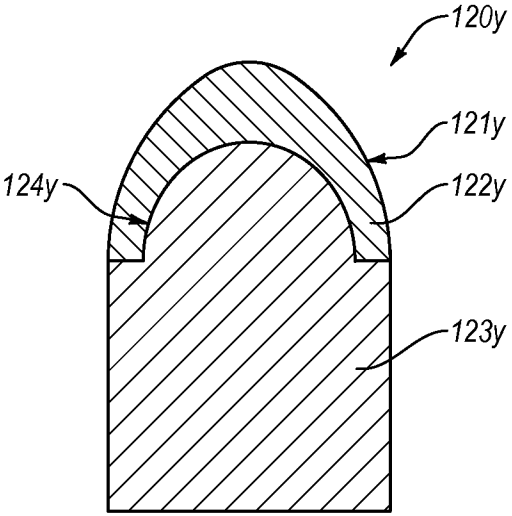
FIG. 9A is a cross-sectional view of a cutting element according to an embodiment of the invention.

While the cutting tool assemblies described above include cutting elements having generally planar surfaces, this disclosure is not so limited. More specifically, working surfaces of the cutting elements may vary from one embodiment to the next and may depend, among other things, on target material intended to be failed thereby. For example, FIG. 9A illustrates a cutting element 120*y* that includes a non-planar superhard working surface 121*y*. It should be appreciated that the cutting element 120*y* may be included in any of the cutting tool assemblies described herein.

At least one embodiment includes the cutting element 120*y* that has a convex, conical, or dome-shaped superhard working surface 121*y*. Moreover, the cutting element 120*y* may include semi-spherical or generally rounded superhard working surface 121*y*. The superhard working surface 121*y* may be formed by or on a superhard table 122*y* that may be bonded to a substrate 123*y*. In some instances, at least a portion of an interface 124*y* between the superhard table 122*y* and the substrate 123*y* may be non-planar. For instance, at least a portion of the interface 124*y* may approximate or follow the shape (or portion of the shape) of the superhard working surface 121*y*. Alternatively, the interface between the superhard table and the substrate may be substantially planar.

In some embodiments, the substrate may be approximately cylindrical and/or may have an approximately uniform peripheral surface (e.g., the substrate may have an approximately uniform or unchanging cross-sectional perimeter). Alternatively, as shown in FIG. 9B, the substrate may include one or more steps. In particular, FIG. 9B illustrates a cutting element 120*z*, which includes a superhard table 122*z* bonded to the substrate 123*z*. More specifically, in an embodiment, the substrate 123*z* includes an upper bonding portion 125*z* and a lower stem portion 126*z*, which may be attached to or integrated with the bonding portion 125*z*.

In some instances, the bonding portion 125*z* may have an approximately the same peripheral size and/or shape as the superhard table 122*z*. Furthermore, in an embodiment, the stem portion 126*z* may have a different peripheral size and/or shape than the bonding portion 125*z* (e.g., the stem portion 126*z* may have a smaller outside diameter than the bonding portion 125*z*). It should also be understood that the cutting element 120*z* may be included in any of the cutting tool assemblies described herein.

Figure 10A:
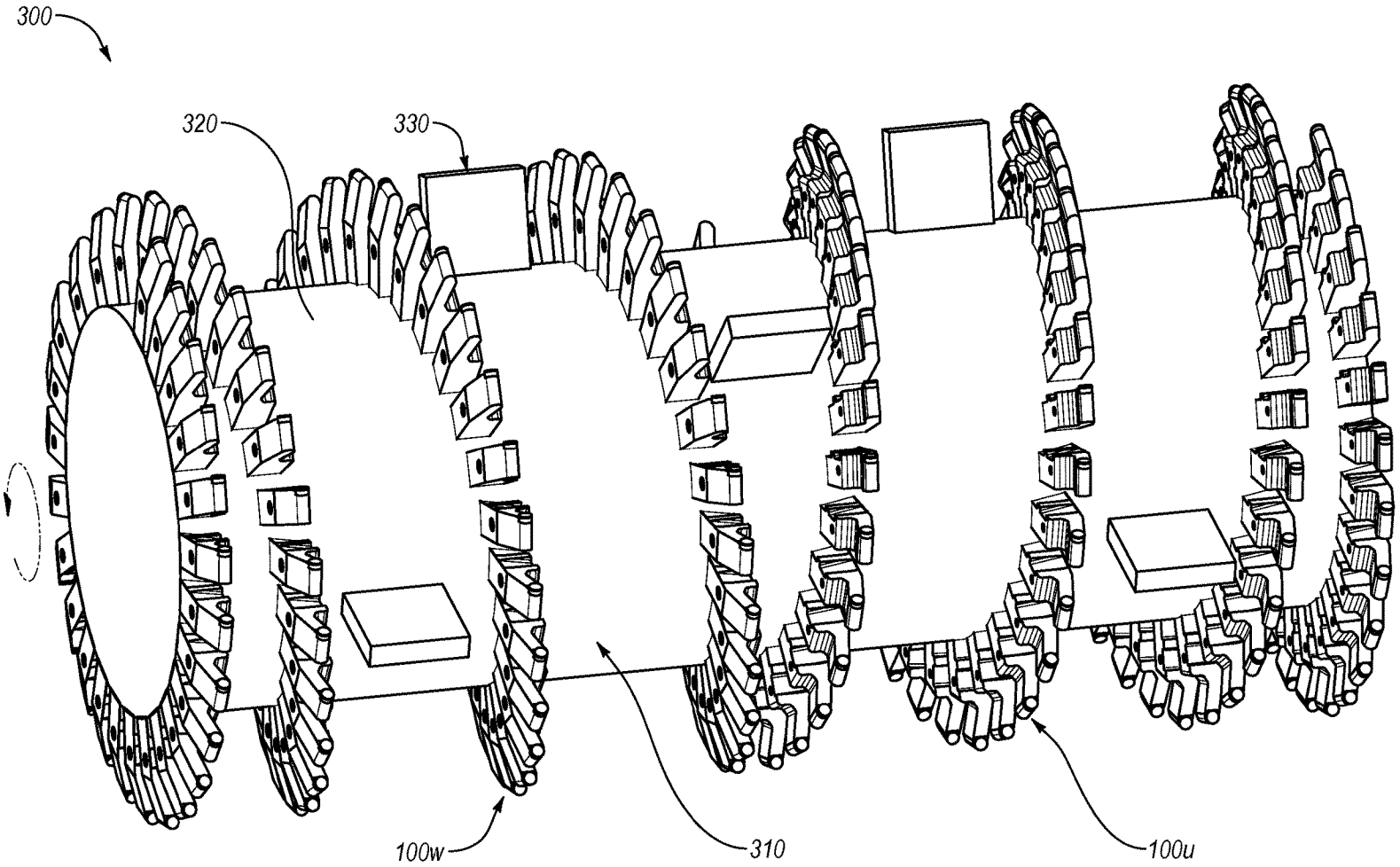
FIG. 10A is an isometric view of a rotary drum assembly according to an embodiment of the invention.

FIG. 10A illustrates an embodiment of a rotary drum assembly 300, which may include any number of cutting tool assemblies, such as cutting tool assemblies 100*u*, 100*w*. It should be appreciated, however, that the rotary drum assembly 300 may include any of the cutting tool assemblies described herein or combinations thereof. In addition, the rotary drum assembly 300 may include one or more conventional cutting tools (e.g., conventional tools that do not include a superhard working surface).

In an embodiment, the rotary drum assembly 300 includes a drum body 310 that may have an outer surface 320, which may have a substantially cylindrical shape. It should be appreciated that the shape of the outer surface 320 may vary from one embodiment to the next. For example, the outer surface 320 may have oval or other non-cylindrical shapes. In addition, the drum body 310 may be solid, hollow, or tubular (e.g., the drum body 310 may have a cored-out inner cavity or space). In any event, the drum body 310 may have sufficient strength and rigidity to secure the cutting tool assemblies 100*u*, 100*w* and to remove material, as may be suitable for a particular application.

Similarly, a cutting exterior of the rotary drum assembly 300, which may be formed or defined by the cutting tool assemblies 100*u*, 100*w*, may have an approximate cylindrical shape. More specifically, superhard working surfaces of the cutting tool assemblies 100*u*, 100*w*, collectively, may form an approximately cylindrical cutting exterior. It may be appreciated that the particular shape of the cutting exterior formed by the cutting tool assemblies 100*u*, 100*w* may depend on the shape of the superhard working surfaces and on the orientation of the cutting tool assemblies 100*u*, 100*w* relative to the drum body 310, among other things.

Moreover, the cutting tool assemblies 100*u*, 100*w* may have any number of suitable patterns and/or configurations on the drum body 310, which may vary from one embodiment to the next. For example, cutting tool assemblies 100*u*, 100*w* may form helical rows about the drum body 310, and such rows may wrap about the circumference of the drum body 310. Furthermore, helical row(s) formed by the cutting tool assembly 100*u* may have a different orientation of the helix than the helical row(s) formed by the cutting tool assembly 100*w*. In any event, the cutting exterior of the rotary drum assembly 300 may rotate about the center axis of the drum body 310 to cut, grind, or otherwise fail the target material by engaging the target material with the cutting tool assemblies 100*u*, 100*w*.

Additionally, the helical arrangement may facilitate movement of the failed material between the cutting tool assemblies 100*u*, 100*w* and removal thereof from a worksite. Also, the rotary drum assembly 300 may include one or more paddles 330, which may be located between the cutting tool assembly 100*w* and/or cutting tool assembly 100*u*, as shown. The paddles 330 may facilitate transferring of the failed material away from the worksite (e.g., to a conveyor belt in a material-removing machine).

Figure 10B:
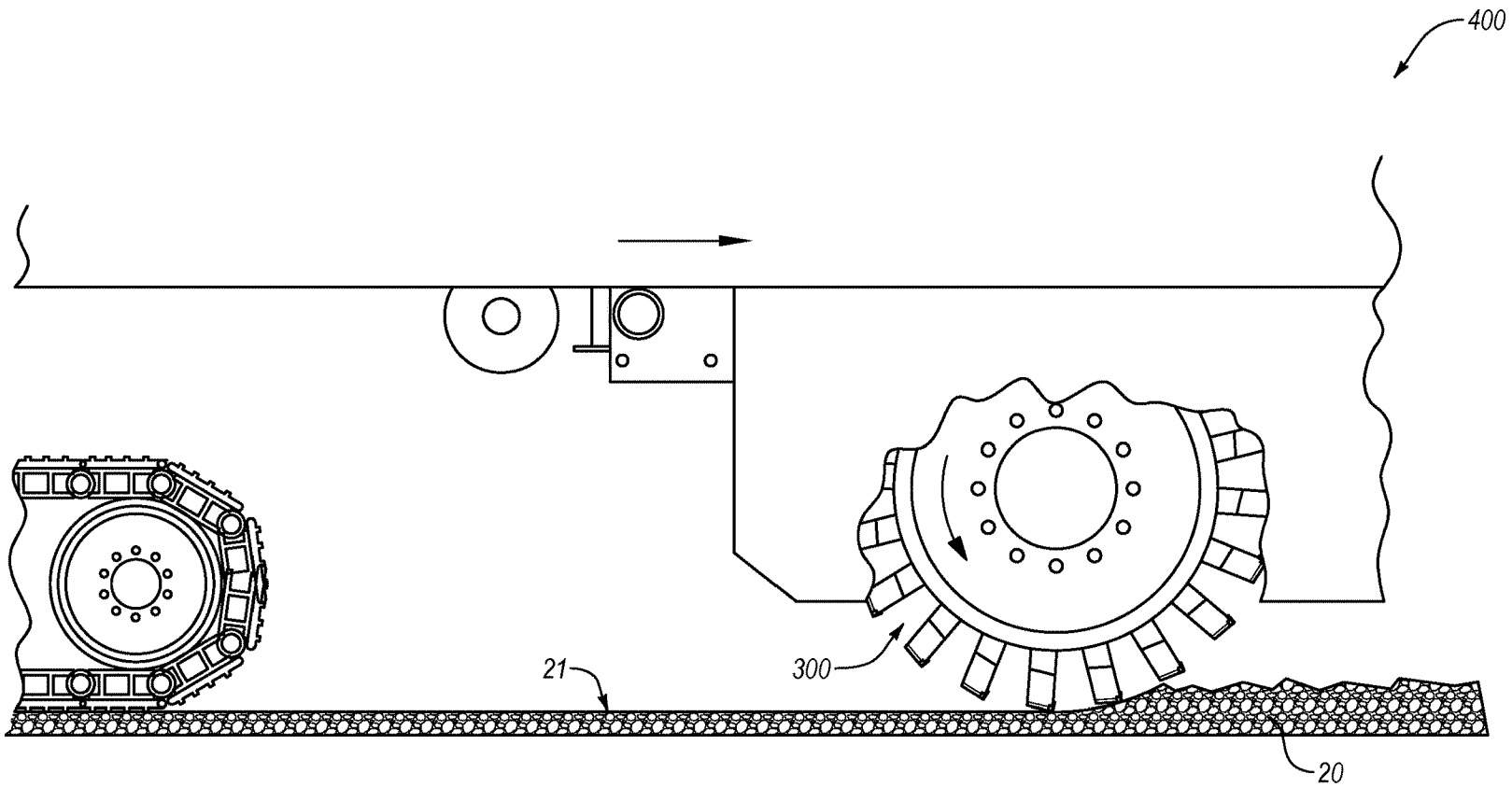
FIG. 10B is a side view of a material-removing machine according to an embodiment of the invention.

FIG. 10B illustrates an embodiment of a material-removal machine 400, which may incorporate the drum assembly 300. Particularly, as the material-removal machine 400 moves (e.g., in a direction indicated by an illustrated arrow), the drum assembly 300 may rotate in a manner that produces material failure and/or removal.

In some instances, the rotation of the drum assembly 300 and movement of the material-removing machine 400 may produce conventional cutting motion, where cutting tool assemblies engage the target material in the same direction as the direction of the movement of the material-removal machine 400 (i.e., as shown in FIG. 10B). Alternatively, the rotation of the drum assembly 300 and movement of the material-removing machine 400 may produce a climb cutting motion, where the cutting tool assemblies of the drum assembly 300 engage the target material in a direction opposite to the movement of the material-removing machine 400. Furthermore, in some instances, the material-removing machine 400 may engage material at a final or finished depth of cut. Alternatively, the material-removing machine 400 may engage the target material at an unfinished or partial depth, such as to achieve the finished depth after multiple passes. In any case, rotation of the drum assembly 300 together with the movement of the material-removal machine 400 may remove at least a portion of the target material.

In an embodiment, movement of the material-removal machine 400 together with the rotation of the drum assembly 300 may remove a portion of a pavement 20, thereby producing a cut surface 21. Removed pavement may be subsequently recycled. Additionally or alternatively, the material-removal machine 400 may remove material in any number of suitable applications, including above ground and underground mining.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

We claim:

1. A cutting tool assembly configured for mounting to a rotary drum assembly, the cutting tool assembly comprising:
- a support block having a support block longitudinal axis, the support block including:
  - a mounting end exhibiting a first width, the mounting end being sized and configured to attach to the rotary drum assembly, the mounting end including a top surface; and
  - a working end exhibiting a second width that is less than the first width, the working end including a side surface forming an acute angle with the top surface of the mounting end, wherein the top surface and the side surface at least partially define a concave carve-out;
  - a cutting element secured to a front side of the working end of the support block the cutting element having a working surface including a superhard material, the front side adjacent to the side surface; and
  - a shield secured to the support block, the shield being sized and configured to protect at least a portion of the working end during operation of the cutting tool assembly.

2. The cutting tool assembly of claim 1, wherein the shield is positioned at least proximate to the cutting element.

3. The cutting tool assembly of claim 1, wherein the shield has one or more of a higher hardness than the support block, a higher erosion resistance than the support block, or a higher abrasion resistance than the support block.

4. The cutting tool assembly of claim 1, wherein the shield is removably secured to the support block.

5. The cutting tool assembly of claim 1, wherein the shield includes one or more of a hardened steel, tungsten carbide, cubic boron nitride, or diamond.

6. The cutting tool assembly of claim 1, wherein the shield includes one or more of a hardfacing, a coating, or plating applied to at least a portion of the working end of the support block.

7. The cutting tool assembly of claim 1, wherein the working surface is parallel to the support block longitudinal axis.

8. The cutting tool assembly of claim 1, wherein the working surface is oriented at a non-parallel angle relative to the support block longitudinal axis.

9. The cutting tool assembly of claim 1, further comprising at least a second cutting element secured to the support block, the at least a second cutting element having a working surface that includes a superhard material.

10. The cutting tool assembly of claim 9, wherein the working surface of the second cutting element has a different orientation than the working surface of the cutting element, and the cutting tool assembly is configured to be indexed in a manner that selectively positions for operation the working surface of the cutting element or the working surface of the second cutting element.

11. The rotary drum assembly of claim 1, further comprising one or more additional cutting elements secured to the support block.

12. The rotary drum assembly of claim 11, wherein at least one of the one or more additional cutting elements includes a working surface facing in a different direction than the working surface of the cutting element.

13. The cutting tool assembly of claim 1, wherein the shield exhibits a concave surface that generally corresponds to at least a portion of an exterior shape of the cutting element.

14. The cutting tool assembly of claim 13, wherein the concave surface of the shield includes a cutout or a notch.

15. The cutting tool assembly of claim 1, wherein:

the shield includes at least one tapered or beveled side; and the working end includes at least one angled surface that corresponds to and abuts the at least one tapered or beveled side of the shield.

16. The cutting tool assembly of claim 1, wherein:

the mounting end includes a first lateral side and a second lateral side, wherein the first width of the mounting end is measured between the first lateral side and the second lateral side; and the working end includes a proximal end that is adjacent to the mounting end and a distal end that is spaced from the mounting end, wherein the proximal end is closer to the first lateral side of the mounting end than the second lateral side of the mounting end, and wherein the working end extends from the mounting end and is angled towards the second lateral side of the mounting end.

17. The cutting tool assembly of claim 16, wherein the working end extends from the mounting end at an oblique angle such that the distal end of the working end is positioned closer to a plane partially defined by the second lateral side of the mounting end than the proximal end of the working end.

18. The cutting tool assembly of claim 1, wherein the mounting end is integrally formed with the working end.

19. A cutting tool assembly, comprising:

a support block including a support block longitudinal axis, the support block including:

a mounting end exhibiting a first width, the mounting end being sized and configured to attach to a material removing machine, the mounting end including a top surface; and a working end exhibiting a second width that is less than the first width, the working end including a side surface forming an acute angle with the top surface of the mounting end, wherein the top surface and the side surface at least partially define a concave carve-out;

a cutting element having a working surface including superhard material, the cutting element being secured to a front side of the working end, the front side adjacent to the side surface; and a shield secured to the support block and sized and configured to protect at least a portion of the working end from at least one of wear, erosion, or abrasion.

20. The cutting tool assembly of claim 19, wherein the shield includes one or more of a heat-treated steel or a tungsten carbide.

21. The cutting tool assembly of claim 19, wherein the shield has a conical or an approximately pyramid-like shape.

22. The cutting tool assembly of claim 21, wherein the support block and the shield include corresponding locating features that locate the shield relative to the support block.

23. The cutting tool assembly of claim 19, wherein the shield is removably secured to the support block.

24. A rotary drum assembly, comprising:

a drum body; and at least one cutting tool assembly mounted to the drum body, the at least one cutting tool assembly including:

a support block having a support block longitudinal axis, the support block including:

a mounting end exhibiting a first width, the mounting end being sized and configured to attach to the drum body, the mounting end including a top surface; and a working end exhibiting a second width that is less than the first width, the working end including a side surface forming an acute angle with the top surface of the mounting end, wherein the top surface and the side surface at least partially define a concave carve-out;

a cutting element secured to a front side of the working end of the support block, the cutting element having a working surface including a superhard material, the front side adjacent to the side surface; and a shield secured to the support block, the shield being sized and configured to protect at least a portion of the working end during operation of the cutting tool assembly.

25. The rotary drum assembly of claim 24, wherein the shield is positioned at least proximate to the cutting element.

26. The rotary drum assembly of claim 24, wherein the shield has one or more of a higher hardness than the support block, a higher erosion resistance than the support block, or a higher abrasion resistance than the support block.

* * * * *